US007770264B2

(12) United States Patent
Dreyer

(10) Patent No.: US 7,770,264 B2
(45) Date of Patent: Aug. 10, 2010

(54) METHOD, SYSTEM AND SYSTEM COMPONENTS FOR THE APPLICATION OF HOLDING CLIPS TO OBJECTS AND HOLDING CLIPS IN PARTICULAR FOR DOCUMENTS AS SUCH

(76) Inventor: Brigitte Dreyer, Zacherlstrasse 4, Ismaning (DE) 85737

( * ) Notice: Subject to any disclaimer, the term of this patent is extended or adjusted under 35 U.S.C. 154(b) by 719 days.

(21) Appl. No.: 10/891,447

(22) Filed: Jul. 15, 2004

(65) Prior Publication Data

US 2005/0150084 A1 Jul. 14, 2005

(30) Foreign Application Priority Data

Jul. 24, 2003 (DE) ..... 103 33 785
Mar. 12, 2004 (DE) ..... 10 2004 012 263

(51) Int. Cl.
*B42F 1/06* (2006.01)

(52) U.S. Cl. ..... 24/67.9

(58) Field of Classification Search ..... 24/67.9, 24/563, 67.3, 67 R, 545–547, 561, 555, 556, 24/DIG. 8, DIG. 9, 560; 206/340
See application file for complete search history.

(56) References Cited

U.S. PATENT DOCUMENTS 3,057,028 A 4/1958 Lorber
2,835,027 A 5/1958 Phillips
2,938,252 A * 5/1960 Scheemaeker ..... 24/67.9
3,660,870 A 5/1972 Murphy
3,673,641 A * 7/1972 Lorber ..... 24/67.9
3,829,954 A 8/1974 Takamizawa et al.
4,055,874 A * 11/1977 Brown ..... 24/67.3
4,084,864 A 4/1978 Kibler
4,261,098 A 4/1981 Lincoln
4,299,013 A 11/1981 Lincoln
4,353,157 A 10/1982 Sato et al.
4,389,755 A * 6/1983 Villa-Real ..... 24/67.9
4,530,445 A * 7/1985 Decker ..... 221/198
4,876,771 A * 10/1989 Givati ..... 24/298
4,914,791 A 4/1990 Lorber (Continued)

FOREIGN PATENT DOCUMENTS

DE 2312021 11/1973

(Continued)

OTHER PUBLICATIONS

International Search Report for PCT/EP2004/008293, mailed Mar. 3, 2005, 5 pages.

(Continued)

*Primary Examiner*—James R Brittain
(74) *Attorney, Agent, or Firm*—Nixon & Vanderhye P.C.

(57) ABSTRACT

A substantially flat clip element is provided for clamping onto the side edge of an object, such as a stack of papers or documents. Application of the clip element can be effected individually and manually, or a stack of the clip elements can be included within an application device, e.g., in the form of a hand-held and/or desktop device. In another alternative, the clip stack can be provided in a paper processing device, e.g., a finishing station, such that successive groups of papers/documents are clipped together in automatic fashion.

48 Claims, 32 Drawing Sheets

U.S. PATENT DOCUMENTS

| | | | | |
|---|---|---|---|---|
| 5,136,768 | A | 8/1992 | Sato | |
| 5,398,384 | A | 3/1995 | Rinard | |
| 5,404,622 | A | 4/1995 | Sato | |
| 6,086,304 | A * | 7/2000 | Hujishima et al. | 411/443 |
| 6,206,236 | B1 | 3/2001 | Hakala | |
| 6,318,619 | B1 | 11/2001 | Lee | |
| 6,470,536 | B1 * | 10/2002 | Kettlestrings et al. | 24/67.7 |
| 6,557,842 | B2 | 5/2003 | Conard-White et al. | |
| 2002/0150414 | A1 | 10/2002 | Conard-White et al. | |
| 2003/0072637 | A1 * | 4/2003 | Obregon et al. | 411/442 |
| 2003/0076537 | A1 * | 4/2003 | Brown | 358/1.16 |

FOREIGN PATENT DOCUMENTS

| | | | |
|---|---|---|---|
| DE | 37 00 322 | C | 2/1988 |
| DE | 197 04 211 | A | 8/1998 |
| DE | 199 23 915 | A | 12/2000 |
| JP | 10-157326 | | 6/1998 |
| WO | WO 02/28217 | A3 | 4/2002 |

OTHER PUBLICATIONS

European Search Report for RS 111054 DE 02004012263, mailed May 4, 2004, 3 pages.

* cited by examiner

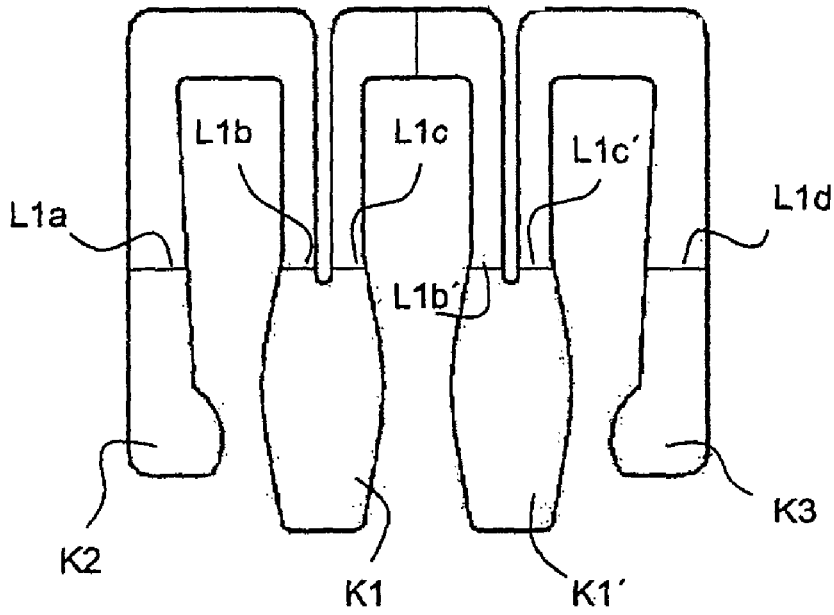
Fig. 13-a
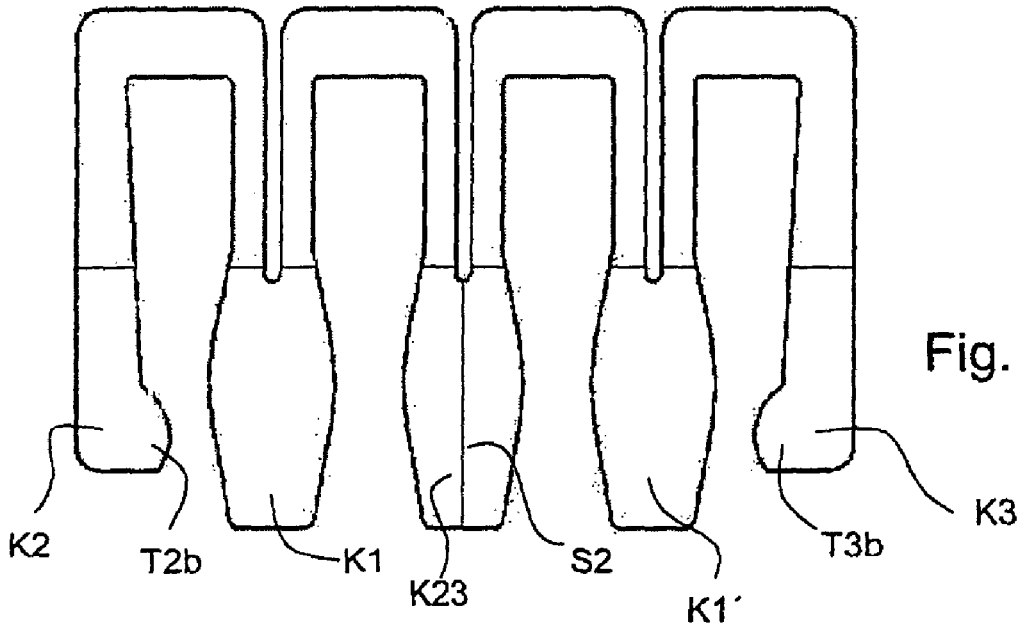
Fig. 13-b

Fig. 19a
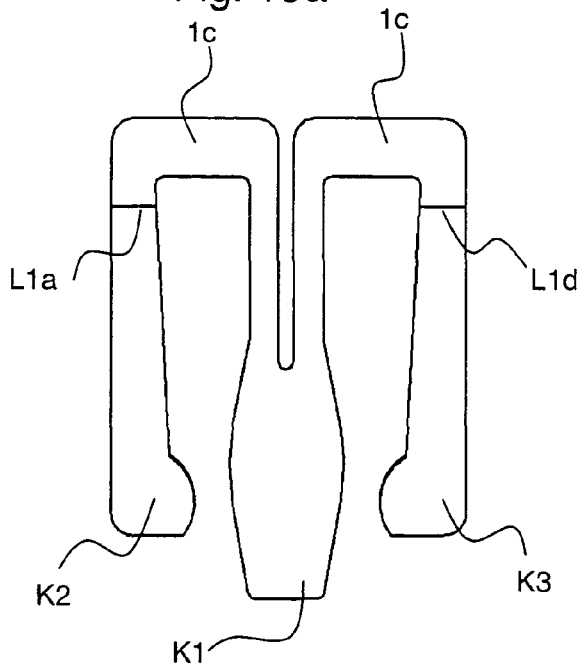
Fig. 19b
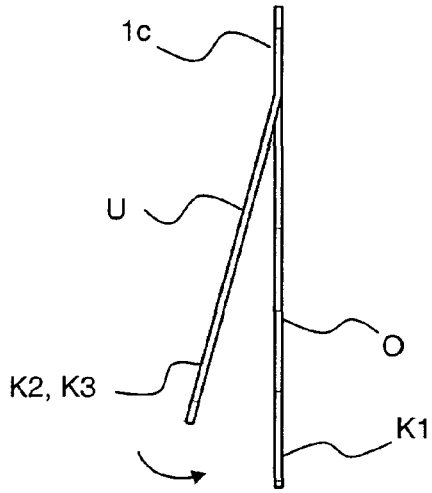
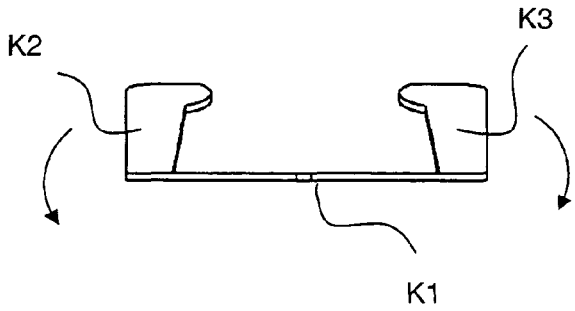
Fig. 19c
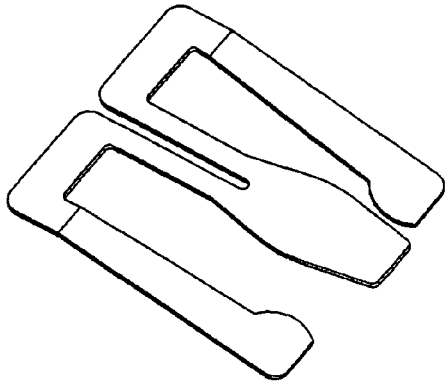
Fig. 19d

Fig. 20a
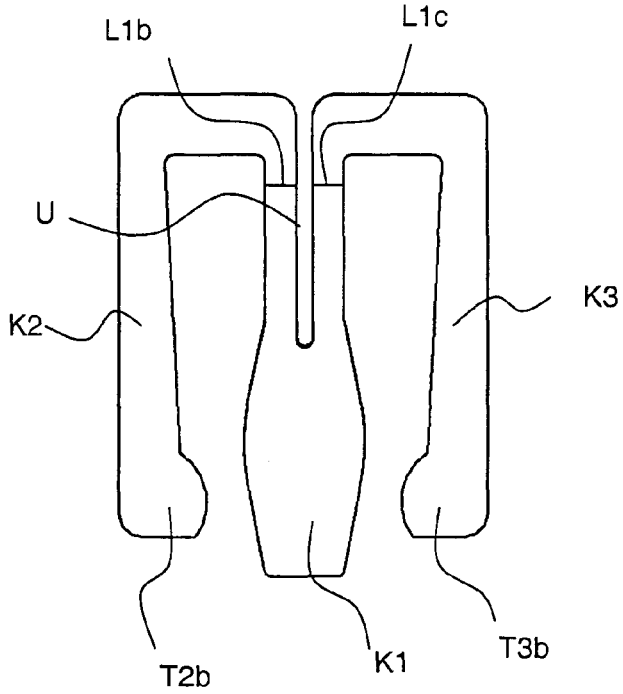
Fig. 20b
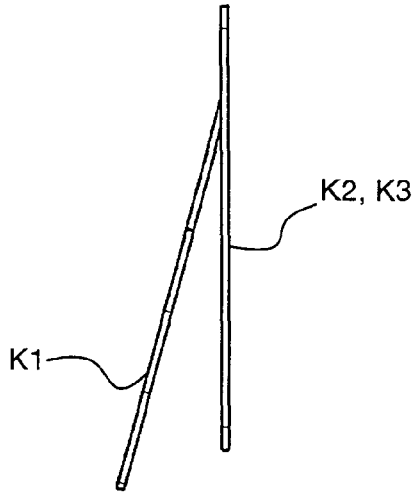
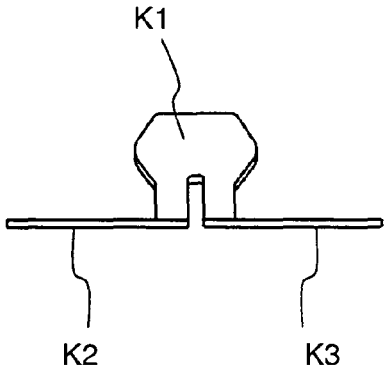
Fig. 20c
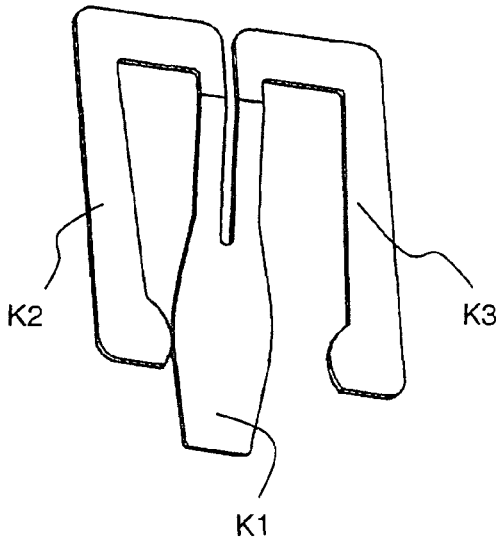
Fig. 20d

METHOD, SYSTEM AND SYSTEM COMPONENTS FOR THE APPLICATION OF HOLDING CLIPS TO OBJECTS AND HOLDING CLIPS IN PARTICULAR FOR DOCUMENTS AS SUCH

CROSS-REFERENCES TO RELATED APPLICATIONS

The present patent application, under 35 U.S.C. §119(e), claims the benefit of German Patent Application No. DE 103 33 785.7, filed Jul. 24, 2003, as well as the benefit of German Patent Application No. 10 2004 012 263.6, filed Mar. 12, 2004, each of which is fully incorporated by cross-reference into the present patent application.

STATEMENT REGARDING FEDERALLY SPONSORED RESEARCH OR DEVELOPMENT (NOT APPLICABLE)

BACKGROUND OF THE INVENTION

1. Field of the Invention

The invention relates to a method for the application of holding clips on edges and borders of objects, in particular paper stacks or documents, by the application of clamping forces. Moreover the invention relates to a device and a system and components of such system for the application of holding clips. The invention also concerns holding clips, in particular holding clips for documents as such, and structure for manufacturing the same.

2. Description of Related Art

Commonly known are holding clips, designated as paper clips, designed as a bent wire piece and in a known manner manually attachable on the edge of a document stack. In order to attach a paper clip on a paper stack or an object the paper clip is usually taken out of a storage unit by hand and under elastic deformation pushed on the edge of the paper stack or the object in such a manner that a first portion of the paper clip is positioned on the upper side of the paper stack or the object, and a second portion of the paper clip is positioned on the underside of the paper stack or object. The paper stack or the object is pinched between the two portions.

The application of the known paper clips by hand proves to be time consuming. Moreover the clipping effect obtained with such paper clips often proves to be insufficient. The object of the patent publications referred to below is to provide technical devices facilitating the application of wire clips.

A device for the application of wire clips is known from U.S. Pat. No. 2,835,027, which comprises a magazine for receiving several wire clips and a punching device by means of which wire clips may be pushed out of the magazine and be expanded.

Another device for the application of wire clips is known from U.S. Pat. No. 3,829,954, which comprises a magazine for receiving loose wire clips and a dispensing mechanism for sending the wire clips out of the magazine and pushing the same on a paper stack. The wire clips are designed in such a manner that the respective clip portions provided to rest on the upper side of the paper stack and on the underside of the paper stack are substantially congruent. Such clip concept is considered disadvantageous because, in particular with thinner paper stacks, the wire clip considerably increases the thickness of the paper stack locally.

A device for the application of wire clips is known from U.S. Pat. No. 6,557,842 B2 which as such is integrated into a copier allowing documents to be wire-clipped.

A device for the application of wire clips is known from WO 02/028217 A2. Just like in the devices described above the clips are first placed into a receiving mouth and from there successively pushed off by a punching device. The wire clips may be pre-assembled in a sleeve and be placed together with such sleeve into the receiving mouth.

Accordingly, a need has developed in the art to provide solutions that provide advantages as against the known clip concepts with regard to the application of holding clips on objects, in particular paper stacks, with regard to the obtained holding effect, or in particular with regard to a space saving storage of the holding clips.

BRIEF SUMMARY OF THE INVENTION

According to a first aspect of the present invention a method for the application of a substantially flat clip element on an object, in particular a paper stack, employing an application device, includes attaching the flat clip element on the object in such a manner that a first portion of the flat clip element rests on an upper side of an object and a second portion of the flat clip element rests on the underside of the object and whereby the first portion and the second portion are under tension due to the application of opposite clamping forces. The flat clip element is mechanically opened to provide a set clipping gap between the first and the second portion, in an entry step the object to be clipped is fed into the clipping gap, and the flat clip element is released in such a manner that the first portion and the second portion rest on the respective object surface.

Preferably, release of the clip element is triggered as soon as the object is inserted far enough into the clipping gap. Thereby it is in an advantageous manner possible to position the flat clip element on the edge of the object in a proper orientation relative to its depth.

According to another aspect of the present invention, a method for the application of a substantially flat clip element on an object by applying an application device, includes attaching the flat clip element on the object in such a manner that a first portion of the flat clip element rests on the upper side of an object and a second portion of the flat clip element rests on the underside of the object, whereby the first and the second portions are under tension, due to the application of opposite clamping forces on a clipping gap receiving the object. The flat clip element is expanded in such a manner that an entry edge of a clipping gap defined between the first and the second portions is sufficiently opened so that the flat clip element may be attached on the object, and the flat clip element is released in such manner that the first portion and the second portion rest on the respective object surface.

Preferably the flat clip element is attached on the object in an expanded condition, in particular pushed on, or it is sufficiently expanded only during the pushing-on movement.

The flat clip element is preferably expanded by guide devices. Alternatively thereto, or in combination therewith, it is also possible to expand the flat clip element by the object itself.

A particularly advantageous application of the flat clip element is obtained in that the object is held by on object holding structure during the object holding phase and the flat clip element is pushed on the object held by the object holding device. It is possible to design the object holding structure in such a manner that the object held by the object holding structure is locally squeezed by the object holding structure.

Preferably the flat element is pushed off a clip stack. The clip stack is preferably designed in such manner that the flat clip elements are combined by said stack to a storage unit, whereby the flat clip elements are preferably detachable from the stack unit by separation forces applied in a defined manner.

According to a particular advantageous embodiment of the invention the flat clip element is pushed off the clip stack by an engaging member. The engaging member may be designed, in particular by its surface shape, so that always only the front most flat clip element is pushed off the clip stack.

According to a particular aspect of the present invention preferably flat clip elements are used which are made out of a flat material or are designed at least in such a manner that they have a material cross section vertically to the clip resting surface and to the push-on direction which parallel to the clip resting area and vertically to the push-on direction is larger than vertically to the clip resting area, i.e. normally to the paper stack or object surface.

According to a particular preferable embodiment of the method the shape of the flat clip element is adjusted to the thickness of the object to be clipped, in particular to the thickness of the paper stack. Such adjustment to the clipping height may be effected in particular in interaction with the engaging and squeezing of the edge of the paper stack, by for instance designing the flat clip element in such a manner that the required clipping space is provided by a defined plastic and moreover admissible elastic deformation of the clip element. Such defined plastic pre-bending may take place directly before or during the application of the clip element. The plastic pre-bending effected by the pre-bending process may be adjusted to the thickness of the object to be clipped. The thickness of the object may be determined by holding structure, e.g., holding pliers or holding jaws. The positioning of the structures effecting the pre-bending may be adjusted by such holding or pre-bending structure.

It is possible to realize the method according to the invention in such a manner that the flat clip element is attached on an edge of the object to be clipped, preferably in a direction following the median line of the corner angle.

Preferably the respective flat clip element is re-shaped over a ramp structure for expanding the clipping space. Expansion may be effected by elastically and/or plastically re-shaping the flat clip element during the pushing-off from the clip stack over guide structures or ramp organs.

The guide structures themselves may be elastically or flexibly designed so that the clip element is expanded only in relation to the thickness of the object or stack.

It is possible to provide technical structure by which the clipped object, in particular the paper stack, is sent out, in particular pushed out of a clip application zone during the application of the clip element.

According to yet another embodiment, a flat clip element stack includes several substantially flat clip elements, whereby each flat clip element is designed to provide a clipping space receiving an object edge due to the application of clamping forces and having a first portion to rest on the upper side of an object and a second portion to rest on the underside of an object, whereby the first and second portions are linked by a bridge portion, and the first portion as well as the second portion and the bridge portion being integrally manufactured out of a flat material, whereby several of such flat clip elements are detachably combined to said flat clip element stack so that for the application of such flat clip element on an object always the front most flat clip element can be pushed off the flat clip element stack.

Thereby it becomes advantageously possible to combine a large number of clip elements to be attached in a space-saving manner in a block-like storage unit, which as such may be fed into a receiving portion of a clipping device, still to be more particularly described below. The particular design of the holding clips as flat clip elements provides on the one hand a compact stack unit and on the other hand also allows the clipping of objects, in particular documents, under reduced local increase of the total thickness. The flat clip element may be designed so that its legs effecting the clipping are extending substantially in push-on direction and positioned adjacent to each other. Preferably the legs are first positioned in a common element plane. The legs may be locally separated from each other by slits or notches extending in push-on direction, in such a manner that at least one of the legs rests with an underside formed by an element underside area on a front side of the object to be clipped and at least one more leg rests with an upper side formed by an element upper side area on an underside of the object to be clipped.

The aggregation of flat clip elements to said flat clip element stack can be effected by a varnish or film structure by which the flat clip elements are connected with each other. The varnish or film structure can be designed in such a manner that it is only on the side edges of the flat clip elements connecting adjacent flat clip elements with each other. The varnish or film structure can be designed in such a manner that it has or forms an image and/or text area. The image area can be used for advertising purposes or can contain information on the number and measures of the clip elements, manufacturer's indicia as well as data on the material quality of the clip elements or a preferred push-on direction of the clip elements stack.

Alternatively to the above mentioned measure or in combination therewith, it is also possible to connect the flat clip elements with each other by an adhesive means. The adhesive means can consist of an adhesive agent and act between the adjacent areas and/or in the edge of the clips.

It is also possible to materially connect the flat clip elements with each other by local solderings or weldings, in particular laser weldings. It is also possible to manufacture the flat clip elements in such a manner that they are connected with each other by bridge portions remaining from manufacture. It is also possible to combine the flat clip elements to a stack or block unit by other mechanical, chemical or physical interaction. It is in particular possible to combine the flat clip elements magnetically to a block by designing them in a ferromagnetic material. It is also possible to design structures on the clip elements clamping or blocking adjacent flat clip elements. Such structures can be designed in particular during a punching process applied for the manufacture of the flat clip element so that units can be formed without any auxiliary or additional block or unit forming structure.

The structures connecting the clip elements with each other, can be designed so that the structure forming the block or unit is irreversibly broken up e.g., via a frangible connection, when the respective clip element is detached. It is also possible to design said structures in such a manner that the unit can be restored so that the loose clip elements can again be combined to a clip element block. The unit forming structures may in particular be designed as punching-embossing structures e.g. as clinch or press button structures. It is also possible to design the structures suitable for forming the block unit as fold, burr, spunk or other reshaping structures. Preferably such reshaping structures are designed at the legs of the flat clip element in such a manner that they are positioned on the object after application of the flat clip element, i.e. advancing to the object and thus not projecting over the open area of the flat clip element.

It is also possible to connect the flat clip elements with each other by a magazine device. The magazine device may be designed as a sleeve body or also have push-in structures, engageable with certain tracks of the flat clip element stack.

It is also possible to link the flat clip elements by a linking structure, which is, for example, inserted into a gap set by the stack, in particular pressed in. Such structure may, for example, be provided as a flat tape section, as a cord section or other strips.

It is also possible to link the flat clip elements at first by a coupling structure, e.g., a tape placed on the stack side, whereby the tape is stripped off the stack after feeding the stack into an application device, so that the clip elements are linked together to said stack only by the receiving device.

Preferably the flat clip elements are made out of a metal material. The flat clip elements may be manufactured in particular by punching processes. The flat clip elements may be shaped in such a manner that in an elastically un-deformed condition they form flat blades. The flat clip elements may insofar be manufactured as flat punched parts. The contour of the flat clip elements can be determined with a view to minimizing waste. It is possible to design the clip elements so that they are formed out of interlocking material areas.

According to a particularly preferable embodiment of the invention the flat clip elements are pre-formed under bending, punching or stretching. Such pre-forming is preferably chosen so that the respective clip element is stiffened by the pre-forming. Such pre-forming may be designed in particular as longitudinal creases. Preferably such longitudinal creases run in push-on direction. Thereby it is possible to guide the front most flat clip element of the flat clip element stack along the underlying flat clip element. The longitudinal creases can be shaped in such manner that they extend into a bridge portion of the flat clip element. The bridge portion may in tendency run in a flat w-form. By such w-form pre-shaping, especially in an attached condition, there is resulting a particularly advantageous contour of the web or bridge portion straddling the edge of the object, in particular the paper stack.

In an advantageous manner it is possible to design the flat clip element so that it has an image section, for instance in the form of a prominent substantially circular head section designed at a central center leg. Such image section may be provided with a punch-out or stamp, e.g., a company logo. It is also possible to provide an image carrier on such image section generated in a printing process. Moreover it is also possible to print on such image section. It is in particular possible to provide the image section with a customized print. The shipment indicia of such customized block units can be printed on the edge of the flat clip element stack. It is possible to link several flat clip element stacks to a stack block. The stack block can be provided with one- or double-sided shipment indicia. The block may be fed into a transport receptacle provided with a window section, through which the shipment indicia are readable.

It is possible to handle the generation of customized, in particular overprinted flat clip elements, as well as the dispatch thereof via an internet surface. Hereby it is possible to have the overprint for the clip elements determined directly by the customer and to carry out delivery of the thus generated flat clip elements on the basis of the also user-input delivery address. Billing of production and sales costs may also be effected via such surface. The user surface for the input of the clip design may partly be used as an advertising space for further offers, whereby target group-oriented advertising may be effected on the basis of the customer-input indicia.

According to another aspect of the present invention the flat clip element can be designed in such a manner that it has a data storage device, in particular an electronic memory device. Such electronic memory device may be provided as a semi conductor structure or as a printed circuit and carry user-determined data. It is possible in particular in connection with document processing systems, such as digital printers or digital copiers, to generate a data record, e.g. a PDF-file, carrying such data in digitalized form which are contained in the documents held together by the clip element. The data record can also contain other information. Preferably in interaction with the flat clip element and the memory device there is realized an interface structure allowing the input and output of data. Data transmission may be effected electro-magnetically, electrically or optically. It is possible to design the flat clip element in such a manner that it may be pushed on a complementary USB plug, flash stick or a smart card and thereby the data record stored on the data carrier of the flat clip element can again be read out or modified by a computer system. It is also possible to set up a document management system on the basis of the document-specific memory device applied by the flat clip element. It is possible to generate filing systems enabling access to the memory device attached to the respective document, so as to enable accessibility to the information contained in a document in paper form as well as by electronic means, whereby paper and data carrier are combined to a single unit by the flat clip element.

According to another aspect of the invention it also relates to an application device for attaching a substantially flat clip on an object, said application device including:

a receiving device to receive a clip stack formed out of flat material clips, a stopper to define the end position of the clip stack, a separator device to separate the respective front most flat material clip, a spreader to expand the respective clip in such a manner that the clip is expanded so that an entry edge of a clipping gap defined between a first and a second portion of the flat clip element is opened wide enough to push the clip on the object, or the object can be introduced into the clipping gap and a release device to release the clip so that the first and the second portions rest on the surfaces of the object facing the clips.

By means of such an application device it is possible in an advantageous manner to attach flat clip elements, which can be stocked in an especially compact manner, successively on the respective objects, in particular paper stacks, without having to take the flat clip element on the hand one by one.

Preferably the receiving device is designed as a guide housing. The guide housing can be designed so that it straddles the clip element stack. It is also possible to design the guide housing so that it engages the clip element stack, in particular in a track or internal groove structure defined by the stacked flat clip elements. It is possible to provide the receiving device with a mounting slide onto which the flat clip element stack can be mounted and pushed into the guide housing together with the mounting slide. The flat clip element stack can be pushed in against the resistance of an elastically biased pusher device.

The pusher device is preferably provided in the receiving device pressing the clip stack against a stopper device into a defined end position. Preferably the stopper device is coupled with the receiving device, in particular integrally designed with the receiving device.

Preferably the stopper device is part of the separator device. The separator device itself preferably comprises a ram element through which the respective front most flat clip element can be separated from the flat clip element stack. It is possible to realize the stopper device in interaction with the ram element, in particular design it at or as part of the ram element.

Preferably the ram element is lead over a ram guide device, so that the ram element with each release step engages the flat clip element stack at a defined position, thereby sending out a flat clip element.

Preferably the ram guide device itself is coupled with the receiving device, in particular integrally designed therewith.

The application device according to the invention may be designed as a freely operable hand applicator, as a desk top unit, or also as part of a document processing system, in particular a printer. The actuation of the ram element and the expanding of the respective flat clip element may be effected manually or supported by a drive.

The application device can be designed in such a manner that it allows the handling of different size clip elements according to the invention. It is possible, for a specific structural shape of the application device, to provide clip elements varying in clipping effect or advantageous clipping thickness. It is possible to design the application device in such a manner that it can store different size clip element stacks and the type of clip can be selected by a simple switch-over of the device or selection of an application mouth. It is also possible to design the application device in such a manner that it can adjust the degree of pre-shaping of the clip element, effecting a bias.

The invention moreover relates to a paper processing device, in particular a printer and/or scanner with a device for generating a paper stack and a device for the application of a holding organ, holding the paper stack together, whereby the device for the application of the holding organ is provided with a receiving structure for receiving an application module and such application module comprising a device for the application of a flat clip element on said paper stack.

Thereby it becomes advantageously possible to automatically attach the flat material clip according to the invention to the respective paper stack generated by the printer.

The application module according to a particularly preferable embodiment of the invention is constructed so that it contains the above described application device as a substructure.

In an advantageous manner the printer is constructed so that alternatively or supplementary to the said flat clip application module a wire clip application module may be inserted for the application of the wire clips penetrating said paper stack.

According to another aspect of the present invention furthermore a paper processing device, in particular a printer, is created with a device for generating a paper stack and a device for the application of a holding organ holding the paper stack together, whereby the paper processing device is designed so that, as a holding organ, it selectively attaches the wire clips penetrating the paper stack or the holding clips, in particular flat material clips, laterally straddling the paper stack.

Thereby it becomes advantageously possible, using the paper processing device, to determine according to which clipping concept the respective paper stack is to be clipped.

It is possible to design the paper processing device so that the wire clips and the holding clips are formed out of a common clip base material, e.g., wire or flat material. Preferably, however, only the wire clips are formed out of a wire-like material portion, whereas the holding clips, as described above, are formed out of a flat material.

Preferably the printer is designed so that the holding clip application module is operable in such a manner that it attaches the holding clip at the edge of the paper stack. Such edge is particularly suitable for the application of the holding clip element.

According to another aspect of the invention, a substantially flat clip element for the application of clamping forces on both sides of an object edge includes:

a base member manufactured out of an elastically deformable flat material, a first portion formed by the base member resting in application position on the upper side of an object, a second portion formed by the base member resting in application position of the flat clip element on the underside of the object, and a bridge portion formed by the base member connecting the first and the second portion and extending in application position of the flat clip element in the vicinity of the object edge.

Thereby it is possible in an advantageous manner to hold the paper stack together, in particular pinching it, sufficiently secure under reduced local increase of the thickness of the stack.

Preferably the first portion forms at least one first clamping leg. The second portion preferably forms at least a second clamping leg.

According to a particular aspect of the invention the first and/or second clamping legs are preferably provided with torsion support flanks for applying torsion support forces in such a manner that they align a resting surface of the respective clamping leg essentially parallel to the object contact area.

The torsion support flanks are preferably provided in the area of the roots of the clamping legs. Alternatively, or in a particular advantageous manner in combination therewith, the torsion support flanks are also provided in the area of the front ends of the legs.

The torsion support flanks may advantageously be designed so that they apply a release torsion moment onto the clamping leg, reacting to a torsion moment becoming effective at the bridge portion, because of the lateral forces acting in the bridge portion.

Preferably the second portion comprises two clamping legs. The first portion is in an advantageous manner section-wise divided in a longitudinal direction having an extended, in particular disk-like head portion relative to its width.

Preferably the base member is out of a metal material, in particular steel material, for example X10CrNi18-8. Alternatively it is also possible to manufacture the base member out of a preferably fiber-reinforced plastic material.

The base member may also be designed as a composite material body or be reinforced with a metal insert.

Preferably the base member is provided with a shearing/punched part. Adjacent leg portions are preferably, at least section-wise, separated from each other by shearing areas or notches.

According to a particular aspect of the present invention preferably at least one of the leg portions or the bridge portion is locally crimped, so that there results a defined pre-forming.

Preferably at least one of the leg portions is reinforced by re-shaping structures, in particular crease portions. The crease portions preferably extend into the bridge portion.

The thickness of the base member measured vertically to the paper resting area is preferably in the area between 0.2% and 4.0%, preferably 3.0% of the width thereof.

The length of the base member is preferably in the area between 50 to 140% of the width of the base member. In order to clip DIN A4 sheets the clip element is preferably dimensioned so that its width is in the area of 8 to 30 mm, preferably 12 to 17 mm.

Another aspect of the invention relates to a special substructure ("OEM-head module") of an application device for flat clip elements or clip elements with inward torsion legs, extending close to a bridge section connecting the clamping legs. The substructure comprises a stopper device for determining the position of the front-most clip element of a clip element block, an engaging structure, for pushing off the front-most clip element, and a spreader device for expanding the clip element, whereby the stopper device, the engaging structure and the spreader device are adjusted to one another in such a manner that the positions of the engaging structure relative to the front-most clip element of the clip element block, for positively detaching, expanding, or dispensing the clip elements, is safely provided by said substructure.

The term substantially flat clip element in the present context refers to a structural part functioning as a clip. At least one portion of the clip, e.g., one or more legs of the clip, is designed so that its cross-sectional thickness, as measured transverse to the resting surface of the clip (e.g., a document), is smaller than a cross-sectional width of the portion as measured parallel to the surface and/or transversely to the push-on direction. Stated another way, the flat clip element includes at least one and preferably several portions that have a cross-sectional shape including a major dimension and a minor dimension that is smaller than the major dimension. For example, the cross section may be in the form of a rectangle, an oval, an ellipse, etc.

The solution concept on which the present embodiments are based is in particular but not exclusively characterized by one or more of the following features:

Aggregation of extremely thin and rather flat clip elements or clip element base material sections to a block unit by detachable connecting of adjacent clip elements or clip element base material sections to be used in an application device by which the clip elements or clip element base material sections are deformed and/or expanded for mechanical application thereof;

Creation of a document sorter system selectively allowing an automatic application of such extremely flat holding clips (perforation-free block formation by pinching) and wire clips (formation of blocks by perforation) with for this purpose exchange or preferably choice of module. The document sorter system may be designed so that within a set of documents different clipping concepts (perforating/non-perforating) may be applied menu-driven;

Generation of holding clip elements for perforation-free formation of blocks out of base material sections which are detachably or separably combined to a block provided as a refill unit;

Special contours for holding clip elements for perforation-free formation of blocks, whereby the legs, effecting the clamping, and extending from a rear bridge portion in push-on direction, are provided with structures (torsion legs T2*a*, T3*a*) extending transversely to push-on direction to the central root area of the bridge section, and through which torsion moments are acting on the legs during the clamping process by such structures in such a manner that they apply a release torsion moment in the bridge portion;

Applicator for the application of block-like holding clip elements manufactured out of a flat material by mechanical expansion of the same, whereby expansion is effected either during the push-on process or during the preparatory expanding step.

BRIEF DESCRIPTION OF THE DRAWINGS

Further details and features of the invention are resulting from the below description in connection with the drawing, in which:

FIG. 13*a* is a profile sketch to illustrate a twelfth embodiment of a flat clip according to the invention with altogether four locally crimped leg portions;

FIG. 13*b* is a profile sketch to illustrate a thirteenth embodiment of a flat clip according to the invention with altogether five locally crimped leg portions;

FIG. 19*a* is a profile sketch to illustrate a nineteenth embodiment of a flat clip according to the invention based on the embodiment according to FIG. 7 with locally crimped side legs;

FIG. 19*b* is a side view of the flat clip according to FIG. 19*a;*

FIG. 19*c* is a front view of the flat clip according to FIG. 19*a;*

FIG. 19*d* is a perspective view of the flat clip according to FIG. 19*a;*

FIG. 20*a* is a profile sketch to illustrate a twentieth embodiment of a flat clip according to the invention based on the embodiment according to FIG. 7 with locally crimped center leg;

FIG. 20*b* is a side view of the flat clip according to FIG. 20*a;*

FIG. 20*c* is a front view of the flat clip according to FIG. 20*a;*

FIG. 20*d* is a perspective view of the flat clip according to FIG. 20*a* with the pre-bent center leg for increased bias;

DETAILED DESCRIPTION OF PREFERRED EMBODIMENTS

Figure 1:
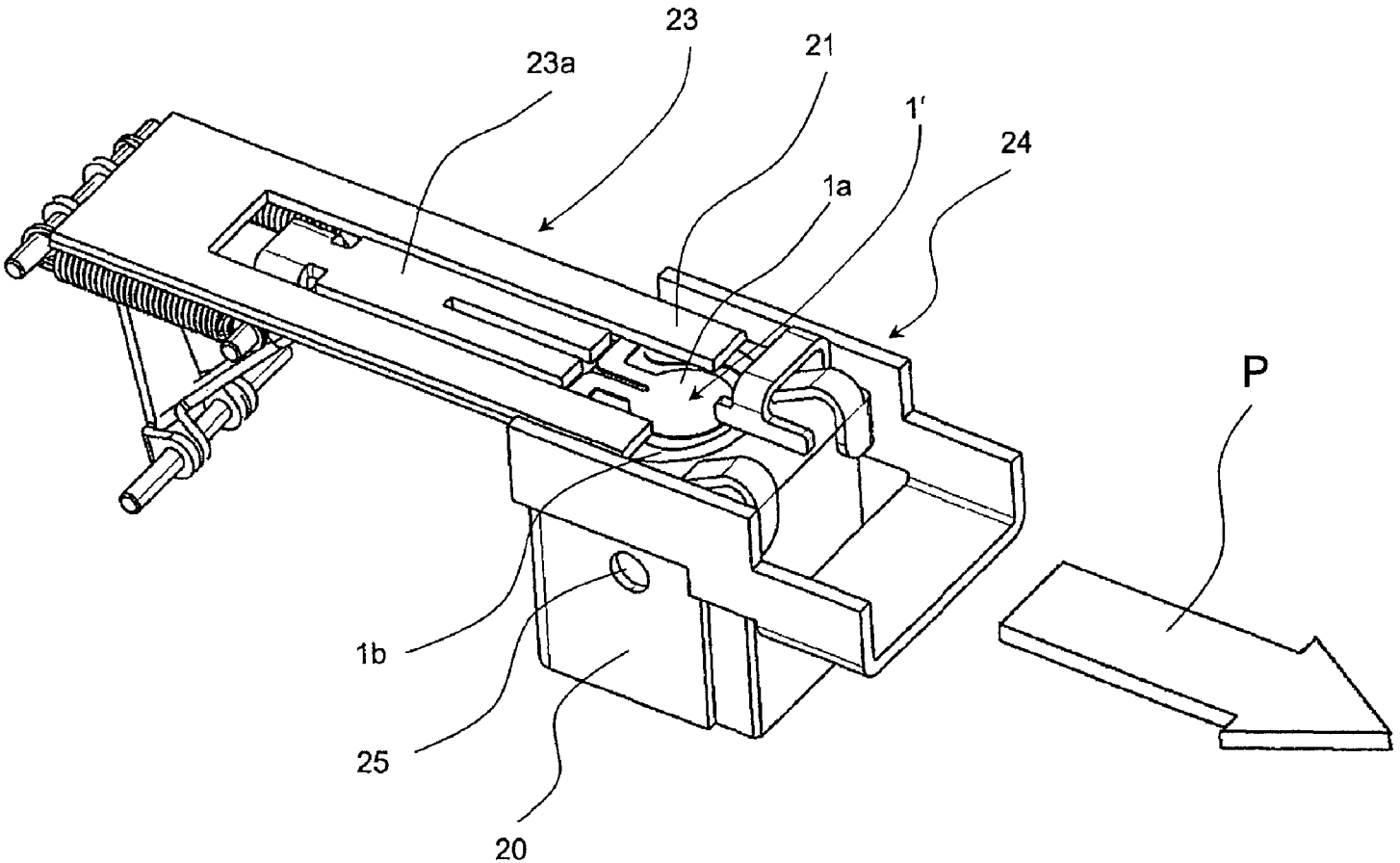
FIG. 1 is a perspective view of selected components of a flat clip applicator according to a preferred embodiment of the invention.

FIG. 1 depicts a perspective view of components of an application device according to an embodiment of the invention for the application of a substantially flat clip on an object.

The shown components are a receiving device 20 for receiving a clip stack formed out of flat material clips 1' (see FIG. 3*c*), a stopper device 21 for fixing an end position of the clip stack, a separator device 23 for separating always the front most flat material clip 1', and a spreader device 24 for expanding the respective pushed-off clip 1' in such a manner that, in a flat clip element expanding step, the clip is expanded to such a degree that an entry edge of a clipping gap defined between a first portion 1*a* and a second portion 1*b* of the flat clip element 1' is sufficiently opened for attaching the flat clip element 1' on an object, in particular a paper stack.

The device moreover comprises a release device, here realized in interaction with the stopper device 21 and the separator device 23 for releasing the clip 1', in particular in a condition in which the first portion 1*a* and the second portion 1*b* rest on the respective object surface facing them.

The receiving device 20 is designed as a guide housing including a pusher member 25 designed as a push feeding element, for pushing the clip stack against said stopper device 21.

The stopper device 21 is connected with the receiving device 20 or integrally designed with the receiving device 20.

The separator device is provided with a ram element 23*a* which is guided by an actuating device, here outlined as toggle mechanism, in interaction with the stopper device 21, partly also acting as a ram guide 21, in such a manner that the ram element 23*a* can deploy only the front-most flat clip element 1' from the receiving device 20 towards the direction of the arrow P.

Figure 2A:
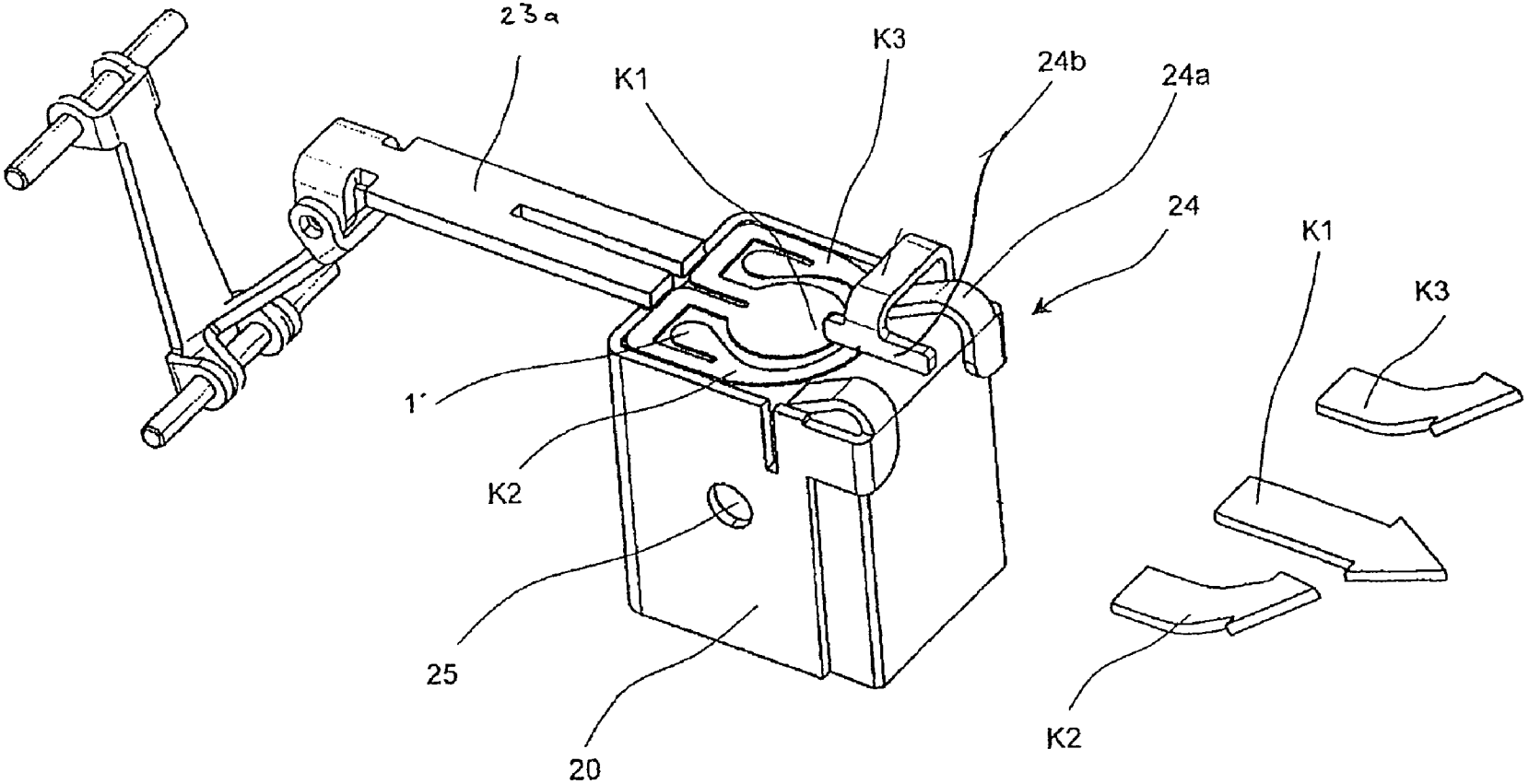
FIG. 2*a* is a further perspective view of the components of a flat clip applicator according to FIG. 1.
Figure 2B:
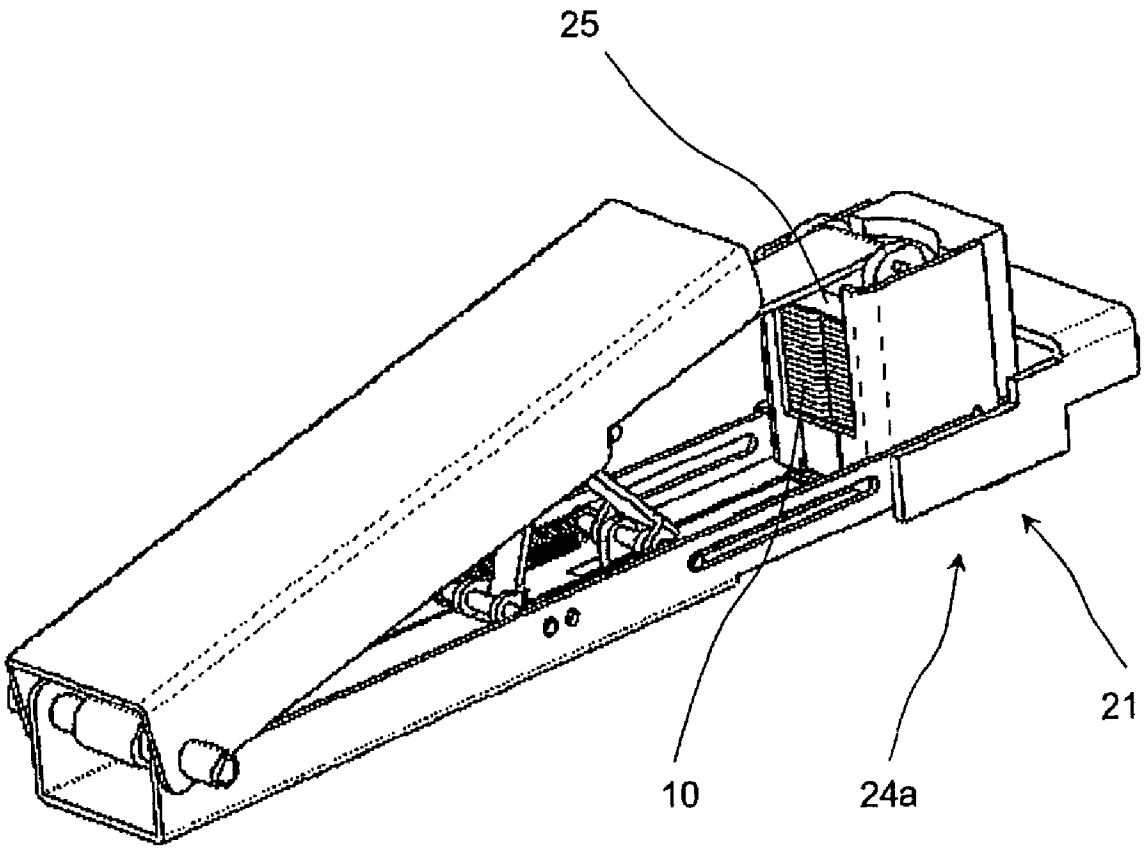
FIG. 2*b* is a further perspective view of the components of a flat clip applicator according to FIG. 1.

The explanations in respect to FIG. 1 generally apply analogously also to the illustrations according to FIGS. 2*a* and 2*b*. The spreader device 24 comprises a guide device 24*a* and a guide stopper 24*b*.

The guide device 24*a* and the guide stopper 24*b* interact in such a manner that with the sending of the respective front most flat clip element 1' out of the receiving device 20 the flat clip element 1' is expanded so that a clipping gap is generated between the clamping legs K1, K2, K3, the gap width of which allows the flat clip element 1' to be pushed on an object edge. In this arrangement the center leg K1 travels substantially straight in the push-on direction. The two side legs K2 and K3 are pushed out by the ramps of the guide device 24*a*, as indicated by the arrows also marked with the reference numerals K2, K3. The guide stopper 24*b* delimits the bulging of the front connecting section of the flat clip element, running in an arch form connecting the two legs K2, K3.

Figure 3A:
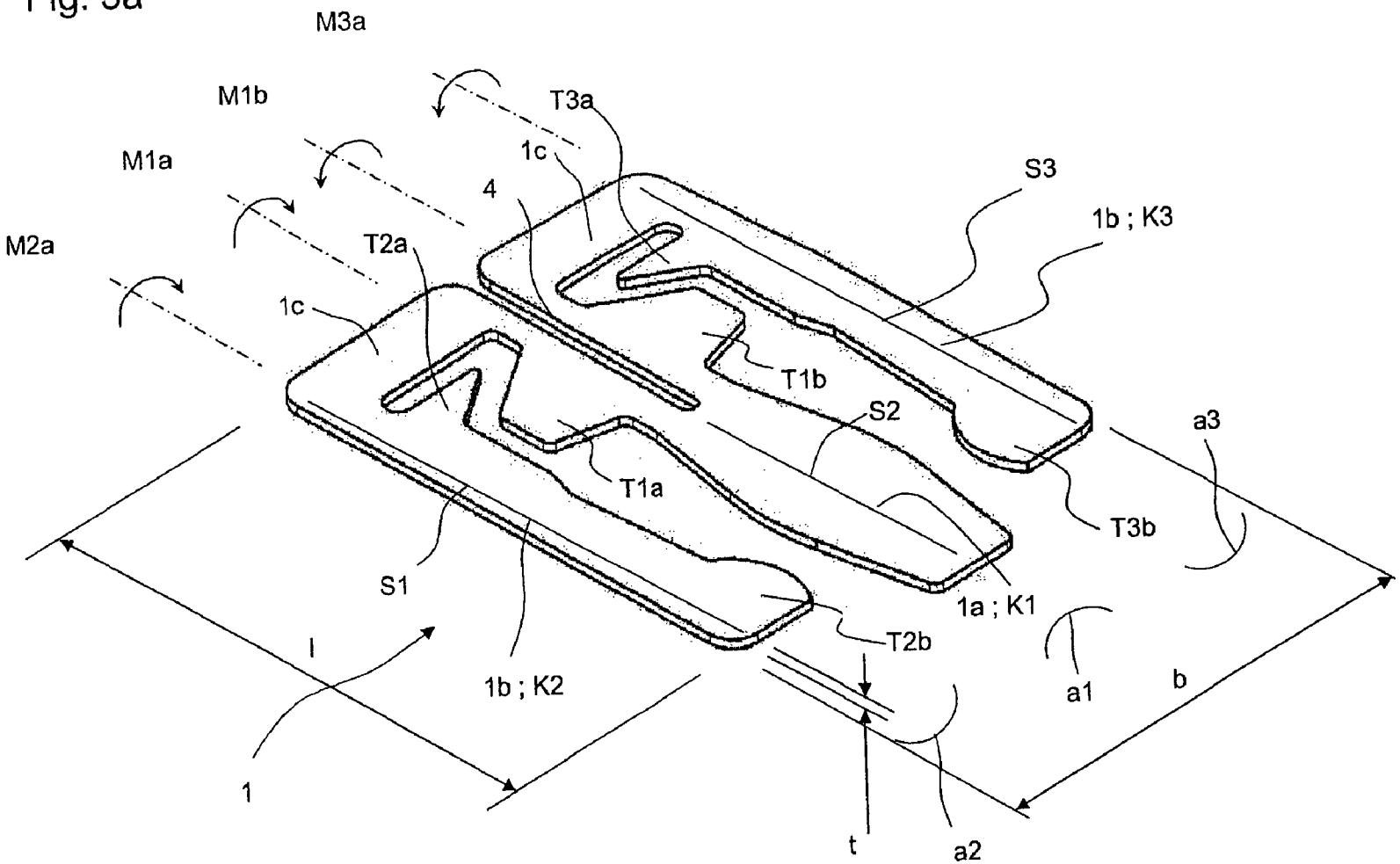
FIG. 3*a* is a perspective outline to illustrate a first embodiment of a flat clip according to the invention with torsion legs provided close to the roots of the legs.
Figure 3B:
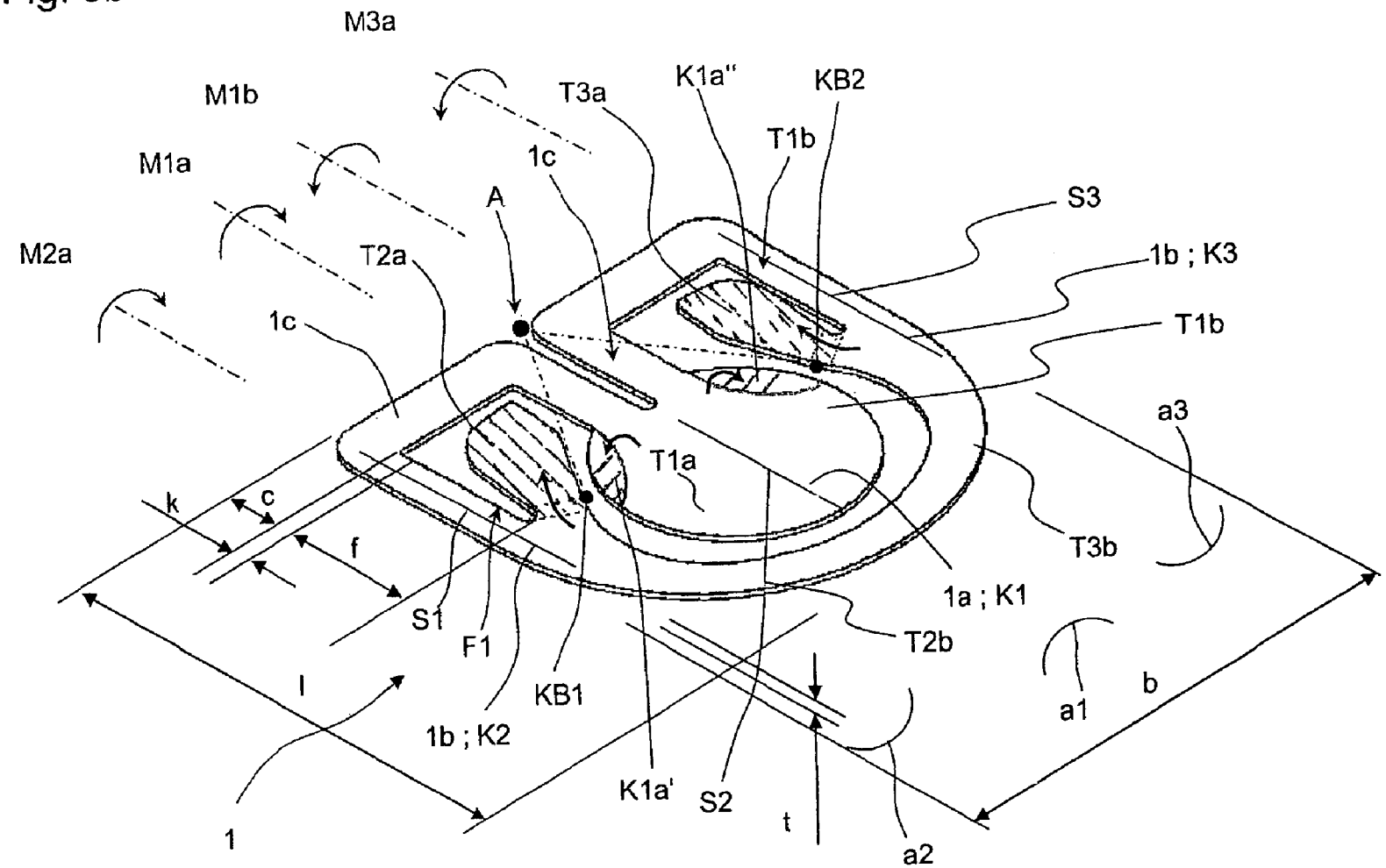
FIG. 3*b* is a perspective profile sketch to illustrate a second embodiment of a flat clip according to the invention with torsion legs provided close to the roots of the legs and clamping legs straddling a central head section and being connected with each other.
Figure 3C:
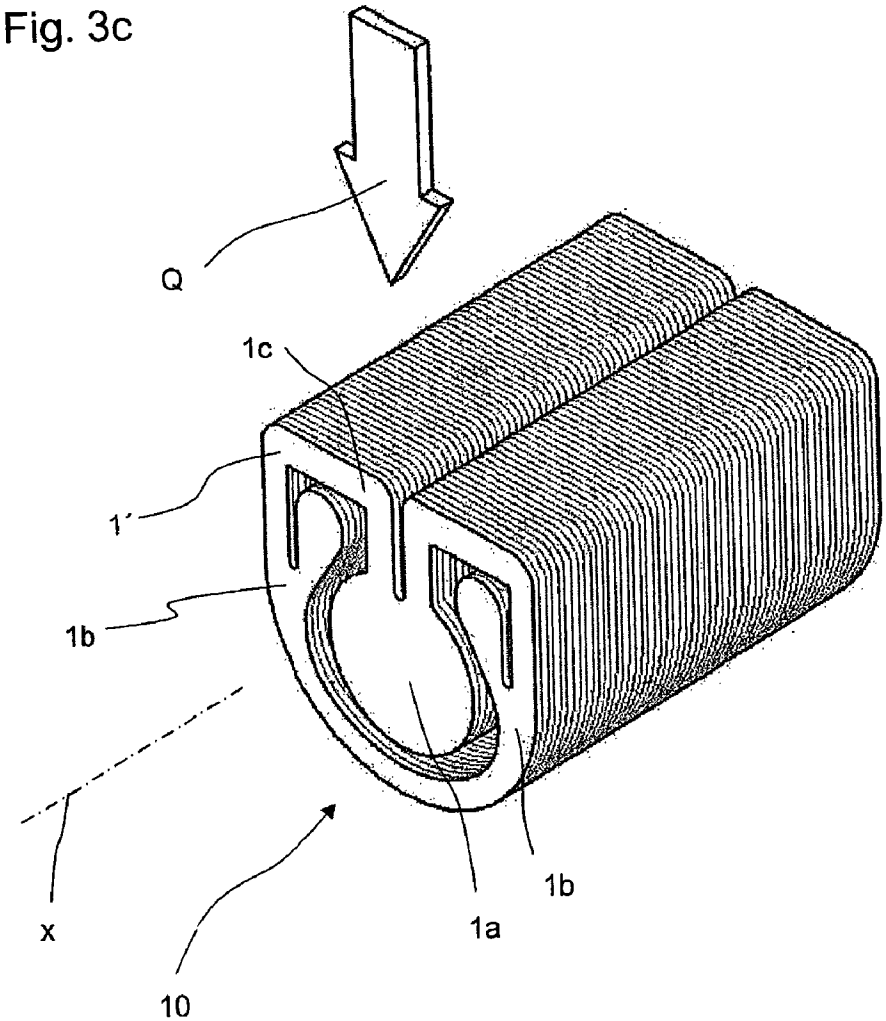
FIG. 3*c* is a perspective view of a clip stack formed out of flat clips according to FIG. 3*b;*

FIG. 2*b* depicts the receiving device 20 (in connection with further actuating components) viewed against the interior of the receiving device provided for receiving a flat clip stack 10 (see also FIG. 3*c*). In order to push the flat clip element stack 10 against the stopper device 21 provided in the front of the receiving device 20 (see FIG. 1) the interior of the receiving device is provided with the pusher device 25, which, for example, under action of a bias spring applies a sufficient pushing force.

FIG. 3*a* depicts a flat clip element for the application of clamping forces on both sides of an edge of an object, in particular paper stack, with a base member 1 manufactured out of an elastically deformable flat material, with a first portion 1*a*, formed by the base member 1, resting in application position on the upper side of an object, with a second portion 1*b*, formed by the base member 1, resting in application position of the flat clip element on the underside of the object, and with a bridge portion 1*c* formed by the base member 1 linking the first portion 1*a* and the second portion 1*b* with each other and extending in application position of the flat clip element into the vicinity of the object edge.

The first portion 1*a* forms a first clamping leg K1. The second portion 1*b* forms two further clamping legs K2, K3.

At the first clamping leg K1 and at the two other clamping legs K2, K3 there are provided torsion support flanks T1*a*, T1*b*, T2*a*, T3*a* for the application of torsion moments M1*a*, M1*b*, M2*a*, M3*a* in such a manner that a resting area of the respective clamping leg K1, K2, K3 is aligned in tendency parallel to the object contact area.

In the shown embodiment the torsion support flanks T1*a*, T1*b*, T2*a*, T3*a* are provided at the edge in the transition area of the clamping legs K1, K2, K3 into the bridge portion 1*c*, e.g., in the area of the roots of the clamping legs K1, K2, K3.

In addition to the mentioned torsion support flanks T1*a*, T1*b*, T2*a*, T3*a* this embodiment is also provided with torsion legs T2*b*, T3*b* in the area of the front ends of the legs.

The torsion support flanks T1*a*, T1*b*, T2*a*, T3*a* and T2*b*, T3*b* are designed in such a manner as to apply such reaction torsion moments on the clamping legs K2, K3 that these react to a bending moment, which becomes effective in the bridge portion 1*c* due to the transverse forces acting in the bridge portion 1*c*.

As already mentioned, the second portion 1*b* in this embodiment comprises two clamping legs K2, K3. The first portion 1*a* is partially divided in the longitudinal direction by a separation area 4.

The first portion 1*a*, or the clamping leg formed by it, respectively, has an extended head portion relative to its width.

The base member 1 is made out of a metal material, in particular a corrosion-proof steel material. Alternatively it is also possible to manufacture the base member out of a plastic material, or design it as a composite material body, or also manufacture it with reinforcing inserts, e.g., metal inserts.

In the depicted embodiment the base member 1 is manufactured as a punched part, whereby the space defined between the clamping legs K1, K2, K3 is created by punching out a flat material portion.

Alternatively to the separation of the clamping legs K1, K2, K3 through punching out of material portions it is also possible to separate the adjacent leg portions K1, K2 or K1, K3 at least partially from each other by shearing areas. Punching and shearing lines may also be realized in combination with each other.

It is also possible to provide the base member 1 by other manufacturing techniques. In particular it is possible to manufacture the base member with a die tool, by which the preferably plastified base material is shaped, in particular reshaped.

It is possible to manufacture the base member 1 by etching, cutting, separation, sintering, erosion, plasma separation, laser separation or press processes (e.g. by press shaping of a wire material) and by electro-chemical, in particular electrolytic means. In particular it is possible to manufacture the base member by electrolytic and/or photochemical means. The mechanical properties of the base member may be locally adjusted to the respective mechanical strains, e.g. by hardening treatments. The base member may be polished chemically, in particular electro-chemically or mechanically. It is possible to roughen the base member at least in the object contact zones and in particular the paper contact zones or to provide it with contours for increased friction.

It is possible to design at least one of the leg portions K1, K2, K3, the bridge portion 1*c*, or in particular the torsion legs T2*a*, T2*b* adjacent to the bridge portion 1*c* locally crimped, so as to obtain an advantageous pre-configuration of the base member 1.

A greater flexural strength of the clamping legs K1, K2, K3 may be obtained by reinforcing at least one of the leg portions by contour structures, in particular crease portions. The crease portions preferably run in push-on direction.

The thickness t of the base member 1 in this embodiment is in the area of 0.2% to 4%, preferably at 3.0% of the width b of the same. The thickness of the base member is in particular in the area of 0.08 to 0.35 mm. The length l of the base member 1 is preferably in the area of 50 to 140% of the width b of the base member 1. In general, at least one of the first and second portions of the clip, e.g., one or more legs, has a cross-sectional shape including a major dimension (in the plane of the object to be clipped) and a minor dimension (transverse to the plane of the object). The cross sectional shape may be in the form of a rectangle, oval, ellipse, etc. In the case of a rectangle, the major cross-sectional dimension is the width of the leg at any given cross section, while the minor dimension would coincide with the thickness t.

The clamping legs K1, K2, K3 are provided with longitudinal creases S1, S2, S3 which are here only indicated as clear edges. The longitudinal creases S1 and S3 extend into the bridge portion 1*c*. By the longitudinal creases S1, S2, S3 the base member is preformed in such a manner that after application on a paper stack it rests thereon with a greater bias. The bridge portion adopts the shape of a W.

The bulging caused by the longitudinal creases S1, S2, S3 is preferably aligned so that the respective clamping leg K1, K2, K3 rests on the paper with a concave side.

If the central clamping leg K1 is to rest on the upper side of the paper, the clamping leg K1 is concavely bent towards the paper stack (symbol a1). The clamping legs K2, K3 resting on the underside of the paper stack are concavely bent towards the underside of the stack (symbols a2, a3), depending on which side of the leg K1, K2, K3 is to rest on the adjacent paper surface.

The foregoing explanations apply analogously to the flat clip element depicted in FIG. 3*b*. In this embodiment the clamping legs K2, K2 encompass a resting head area of the clamping leg K1 which here has a substantially circular form. The clamping legs K2, K3 are accordingly connected with each other by an arched section in front of the resting head area of the clamping leg K1.

The deformation behavior of said flat clip element may be adjusted in particular by the stiffness of the bridge section 1*c* and the elasticity of the torsion legs T2*a*, T2*b*. The torsion legs T2*a*, T2*b* may be provided with elevations or may be slightly crimped, so that for instance the here dotted zones may prop under increased pressure on the underside of the object so as to increase the torsion moments M2*a* and M3*a*. In particular in the area of the torsion legs T2*a*, T3*a* there may be provided friction increasing structures, increasing the pull-off strength of the flat clip element 1.

The edges provided at the torsion legs T2*a*, T2*b* running on the object contact side, may be designed so that they can particularly effectively engage the side of the object to be clipped which is in contact with said edges. The distance of the rear edge of the respective torsion legs T2*a*, T2*b* adjacent to the bridge portion 1*c* is preferably in the area of 5 to 30% of the maximum thickness of an object, in particular paper stack, that can be properly clipped.

The flat clip element 1 depicted here has a width b of 17 mm. The length l is also 17 mm. The bridge portion 1*c* has a depth c of 2 mm. The distance k of the back edge of the torsion flank T2*a* from the bridge portion 1*c* is 1.2 mm. Material thickness t is 0.21 mm. The clip element depicted here is suitable, with the indicated measurements, in particular for clipping paper stacks with a thickness of up to 3.5 mm. For thicker objects it is possible to scale up the flat clip element by preferably maintaining the shown proportions.

The torsion legs T2*a*, T3*a* facing the bridge portion 1*c* have rounded edges here. It is possible here to provide claws or burred structures increasing the pull-off strength. Also at the edges of the central substantially circular head section of the center leg K1 facing the torsion legs T2*a*, T3*a* there may be provided engagement providing structures, in particular crimped portions K1*a*', K1*a*" extending to the object contact side. By the latter crimped portions K1*a*', K1*a*" it is possible, directly on pushing the flat clip element 1 off the respective flat clip element block, to lift the bridge portion 1*c* to a degree substantially corresponding to the projecting height of the crimped portions K1*a*', K1*a*". This facilitates the separation of the flat clip elements 1 from a block in which they are first held together.

The flexibility of the torsion legs T2*a*, T3*a* may be adjusted by the length of relief gaps F1, F2. In the embodiment shown here the length f of the relief gaps F1 is 4.2 mm. The shorter the relief gaps F1, F2 the more inflexibly the torsion legs T2*a*, T3*a* are connected to the respective side leg K2, K3 and the stiffer the clip.

With the depicted clip a clamping effect is generated between the center leg K1 and the two side legs K2, K3, e.g., by a particular clamping principle. The clamping principle is based on the fact that the adjacent edges of the central head section and the torsion legs T2*a*, T3*a* define clipping gaps KB1, KB2, arrow-like inclined towards an apex A. Such a configuration allows a simple pushing on of the clip and at the same time makes it more difficult to pull off the same, because a bulb occurring substantially in the area of the clipping gaps KB1, KB2 at the object to be clipped hinders the pull-off movement. Moreover the zones where the highest clamping forces are acting on the object to be clipped are close together, so that with regard to the deformation of the object to be clipped it is possible here to attach the clip element with rather little deformation. The elastic tension of the clip element zones generating pressure forces is substantially affected by deformation under bending conditions of the bridge section 1*c*, twisting of the side legs K2, K3 and bending of the torsion legs T2*a*, T3*a* adjacent to the bridge portion 1*c*. The degree of elasticity contributed by twisting the side legs K2, K3 and bending the torsion legs T2*a*, T3*a* may be adjusted in particular by the length f of the relief gaps F1 or F2, respectively. In the shown example the measurements of the separation area 4 (gap moving towards head section) additionally contribute to the elasticity in that the thus created webs of the internal clamping leg K1 can act as torsion rod sections.

The term torsion legs in this connection refers to the structures T2*a*, T3*a* shown here, extending from a linking area near the edge inwards towards the center leg K1 and generating in application position a torsional strain on the side legs K2, K3. The torsional strain is in a orientation by which a torsion moment, in tendency acting against the bending of the bridge section 1*c*, is triggered in the bridge section in the linking area of the side legs K2, K3 to the bridge section 1*c*.

FIG. 3*c* depicts a flat clip element stack 10 with several flat clip elements 1' according to FIG. 3*b*, whereby each flat clip element 1' is designed to provide a clipping space for receiving an object edge under the application of clamping forces, and with a first portion 1*a* provided to rest on the upper side of the object and a second portion 1*b* provided to rest on the underside of an object, whereby the first portion 1*a* and the second portion 1*b* are linked with each other by a bridge portion 1*c* and the first portion 1*a*, the second portion 1*b* as well as the bridge portion 1*c* are integrally manufactured out of a flat material, whereby several of such flat clip elements 1' are comprised to form said flat clip element stack 10 detachably combined in such a manner that for successively attaching said flat clip elements 1' on an object, the front most flat clip element 1' can be pushed off the flat clip element stack 10.

Figure 3D:
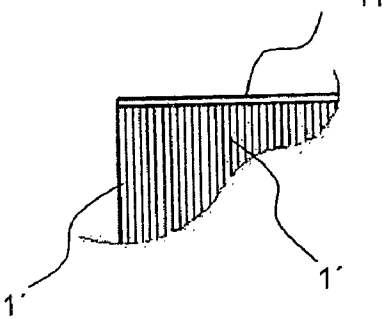
FIG. 3*d* is a sketch to illustrate the clip unit within the clip stack.

As may be seen from FIG. 3*d* the flat clip elements 1' are connected with each other by a varnish or film structure 11. The varnish of film structure 11 may be designed colorless transparent or also form an image and/or text area.

Alternatively to creating the stack block of the clip elements by connecting systems provided at the outer surface of the stack or also in combination therewith, it is also possible to connect the flat clip elements by adhesive means, acting between the main surfaces of adjacent clip elements 1'.

The front most flat clip element 1' can be removed from the stack 10 by the application of a lateral force Q to the edge of the flat clip element 1', said lateral force Q being directed laterally to the stack axis X, so that preferably with the assistance of notching or shearing effects the front most flat clip element 1' is disconnected from the remaining stack.

Figure 4:
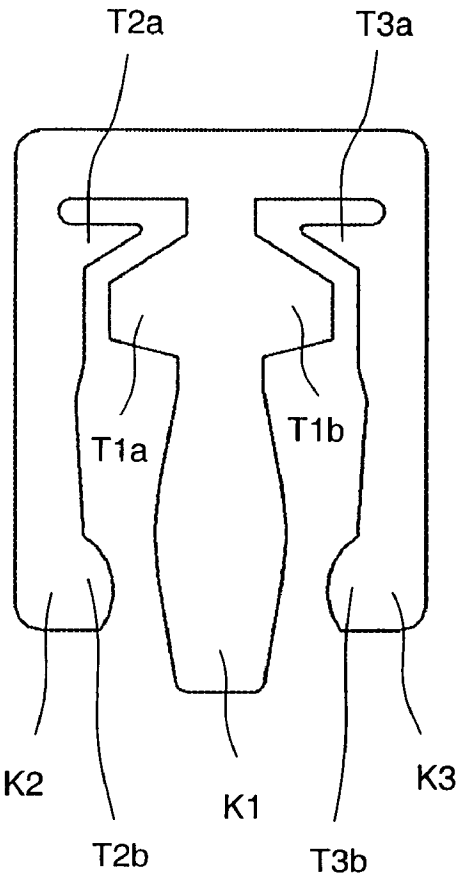
FIG. 4 is a profile sketch to illustrate a third embodiment of a flat clip according to the invention also with torsion legs provided close to the root of the legs.

FIG. 4 is a profile sketch to illustrate a third embodiment of a flat clip according to the invention also with torsion legs T2*a*, T3*a*, T1*a*,T1*b* designed close to the root of the legs. The gap defined between the clamping legs K1, K2, K3 is formed by material punching.

In the area of the head portion of the clamping legs K2 and K3 resting areas T2*b*, T3*b* are provided which also act as torsion legs.

Figure 6:
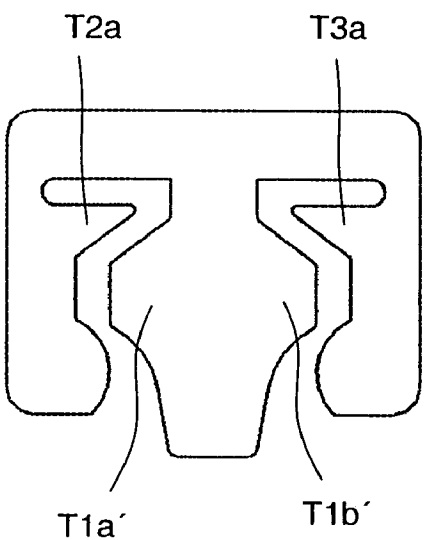
FIG. 6 is a profile sketch to illustrate a fifth embodiment of a flat clip according to the invention also with torsion leg portions provided close to the root of the legs.
Figure 5:
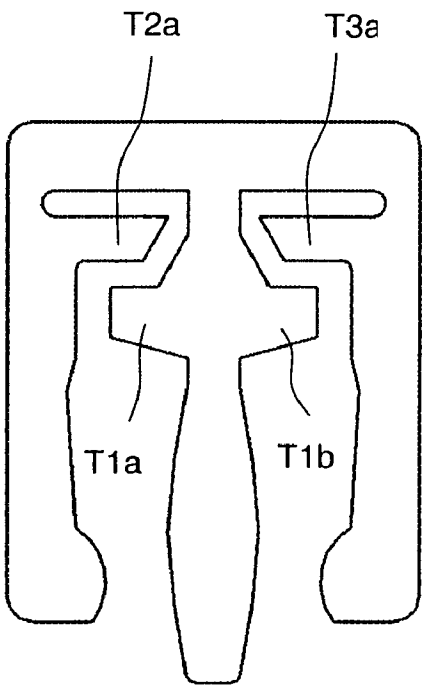
FIG. 5 is a profile sketch to illustrate a fourth embodiment of a flat clip according to the invention also with torsion legs provided close to the root of the legs.
Figure 7:
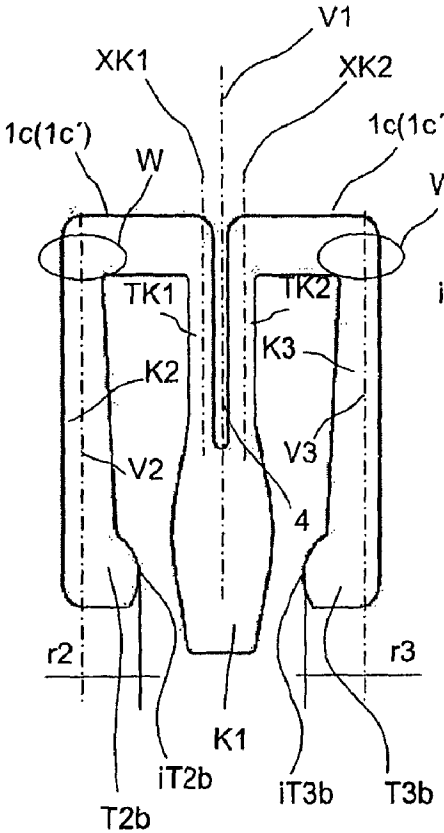
FIG. 7 is a profile sketch to illustrate a sixth embodiment of a flat clip according to the invention with a partially longitudinally divided center leg.

FIG. 5 is a profile sketch to illustrate a fourth embodiment of a flat clip element according to the invention also with torsion legs T2*a*, T3*a*, T1*a*,T1*b* designed close to the root of the legs;

FIG. 6 is a profile sketch to illustrate a fifth embodiment of a compact flat clip according to the invention also provided with torsion legs T2*a*, T3*a* close to the root of the legs and with torsion legs T1*a*',T1*b*' provided somewhat more centrally at the clamping leg K1;

FIG. 7 is a profile sketch to illustrate a sixth embodiment of a flat clip according to the invention with a partially longitudinally divided center leg K1; and with torsion leg zones T2*b*, T3*b* provided merely at the side legs K2, K3 and in particular only in the head portion thereof. This embodiment is characterized by a particular favourable deformation behavior in particular with respect to the recess 4, because by the recess 4 the center leg K1 gets two torsion arms TK1, TK2 which are twistable along the axis XK1, XK2. The length of the recess is preferably adjusted so that the respective bridge arms 1*c*', 1*c*" are deflectable with a torsion moment adjusted to the required clipping effect. Preferably the length of the recess 4 is in an area of 20 to 70% of the length of the internal, in particular center clamping leg K1. Such special design of the inner, in particular center clamping leg, may in a respectively adjusted manner also be realized to increase elasticity of the bridge portion in the further embodiments. The central clamping leg K1 is preferably longer than the side clamping legs K2, K3. It projects preferably about 3 to 20% of the length of the side clamping legs K2, K3.

The clip is measured so that the space between the main axes V2, V3 of the side clamping legs K2, K3 and the central axis V1, or the torsion axes XK1, XK2 is in the area of 110 to 170% of the maximum object thickness provided for such clip. The torsion leg zones T2*b*, T3*b* provided at the head portion of the side legs K2,K3 are preferably designed in such a manner that their inside edges iT2*b*, iT3*b* to the adjacent inside clamping leg—here K1—reach a distance r2, r3 from the respective main axis V2, V3, which amounts to at least 8 to 60% of the distance of the main axes V2, V1 or V3, V1 of adjacent legs. The width of the clamping legs K2, K3 in the respective head portion is larger than that in the respective area close to the root of the leg w.

Figure 8:
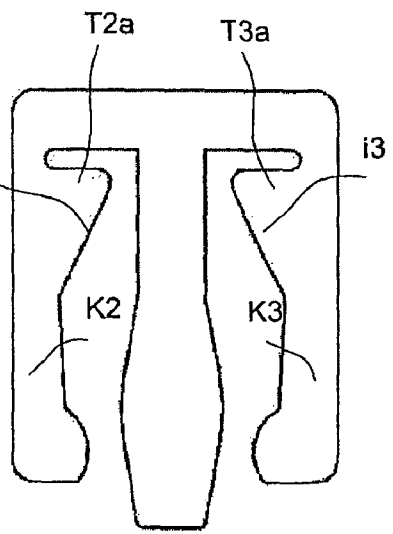
FIG. 8 is a profile sketch to illustrate a seventh embodiment of a flat clip according to the invention again with torsion legs provided close to the root of the legs.

FIG. 8 is a profile sketch to illustrate a seventh embodiment of a flat clip according to the invention with torsion legs T2*a*, T3*a* designed close to the root of the side legs K2, K3. This variation is characterized in a particular preferable way by the torsion legs T2*a*, T3*a* being delimited by an edge i2, i3 facing the center leg, slanting in such a manner that the torsion legs T2*a*, T2*b* are securely deflected by the object to be clipped.

Figure 9:
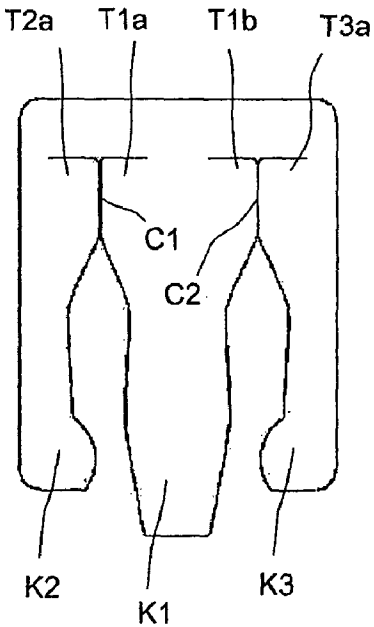
FIG. 9 is a profile sketch to illustrate an eighth embodiment of a flat clip element according to the invention with torsion leg zones provided at the side legs as well as at the center leg and with leg portions separated from each other by partial shearing areas.

FIG. 9 is a profile sketch to illustrate an eighth embodiment of the flat clip according to the invention with torsion leg zones T2*a*,T3*a*,T1*a*,T1*b* provided at the side legs and at the center leg and close to the roots of the legs and with leg portions K1,K2,K3 separated from each other by partial shearing areas or lines C1,C2.

Figure 10:
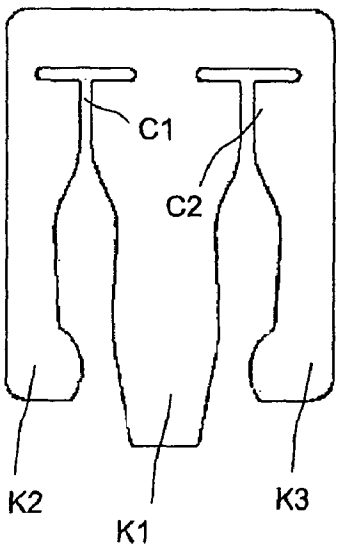
FIG. 10 is a profile sketch to illustrate a ninth embodiment of a flat clip according to the invention similar to FIG. 9, however, with leg portions separated from each other by punched areas.

FIG. 10 is a profile sketch to illustrate a ninth embodiment of a flat clip according to the invention similar to FIG. 9, however, with leg portions K1,K2,K3 separated from each other by punched areas C1', C2'.

Figure 11:
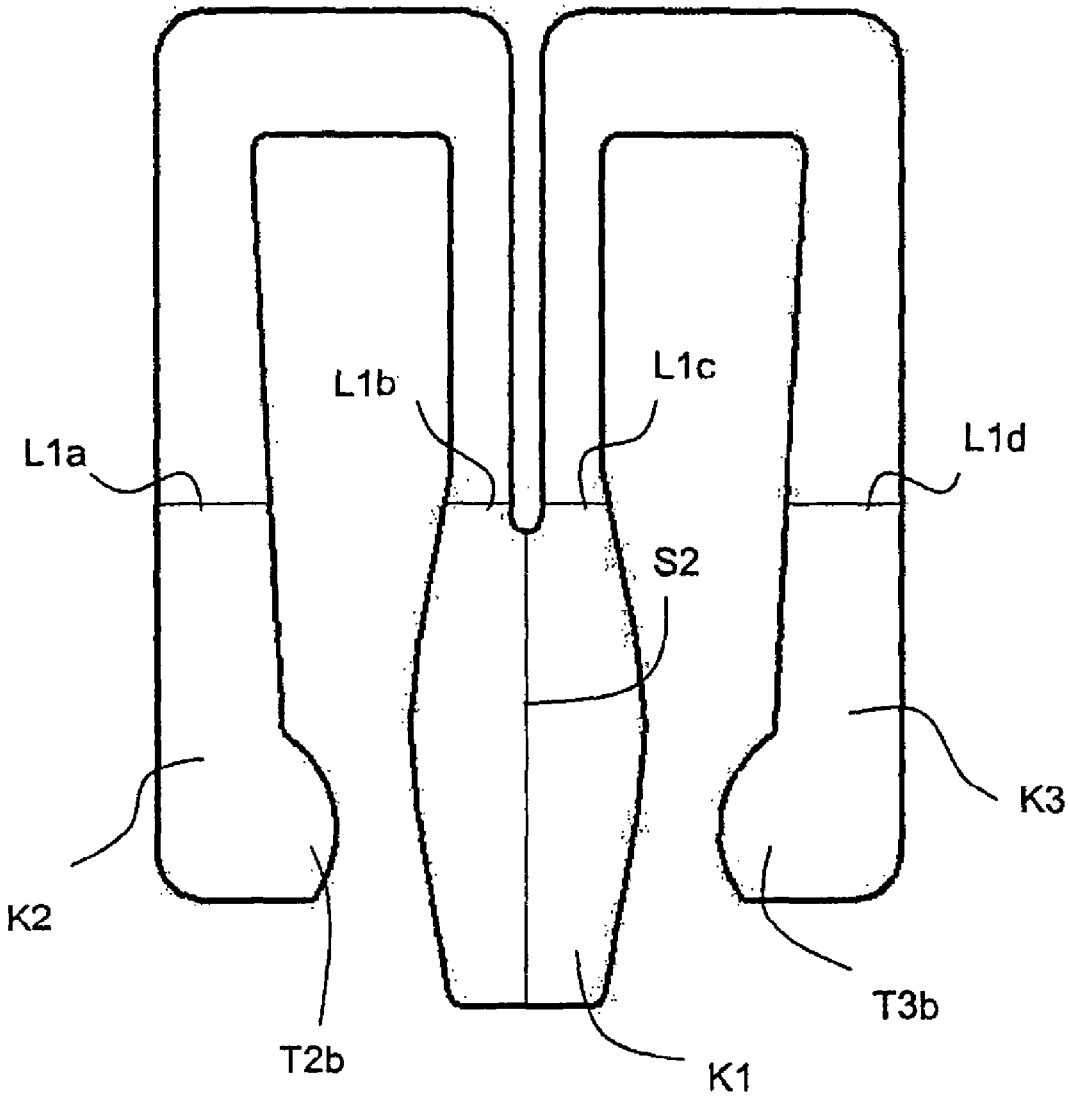
FIG. 11 is a profile sketch to illustrate a tenth embodiment of a flat clip according to the invention with altogether three, locally crimped leg portions.

FIG. 11 is a profile sketch to illustrate a tenth embodiment of the flat clip according to the invention with altogether three leg portions K1,K2,K3 locally bent at crimped sections L1*a*, L1*b*, L1*c*, L1*d*. The central clamping leg K1 moreover has a longitudinal crease S2. In the area of the head portion of the clamping legs K2, K3 there are provided torsion leg zones T2*b*, T3*b*. The central clamping leg K1 is partially divided in longitudinal direction.

The above explanations apply analogously to the embodiments according to FIG. 12*a* to *m*, in particular the explanations concerning the clip elements according to FIGS. 3*a* and 3*b* and FIG. 4 to 11. Substitutionally for the flat clip elements according to FIG. 12*a* to *m*, similar components, zones and portions of the flat clip elements in the embodiment according to FIG. 12*d* are marked with reference numerals corresponding to similar zones, areas and portions of flat clip elements according to FIG. 3*a* to 11.

Figure 12A:
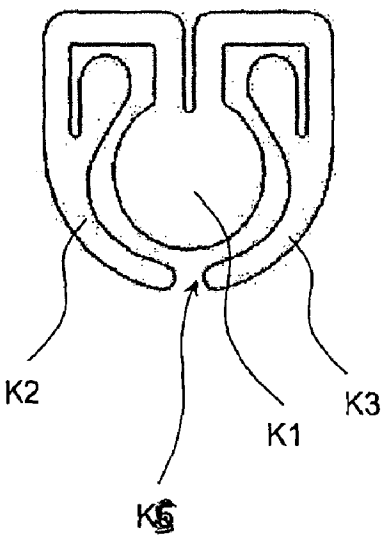
FIG. 12*a* to 12*m* are profile sketches to illustrate various eleventh embodiments of flat clip elements according to the invention with leg portions arched in their front area and at least largely straddling a resting head section.

In the flat clip element according to FIG. 12*a* the legs K2, K3 encompass a front head section area of the first clamping leg K1, here designed substantially as a circular resting area, whereby a tilt gap KS remains between the two clamping legs K2, K3, so that the two clamping legs K2, K3 can be deflected substantially independently from each other, thus providing a relatively smooth clipping.

Figure 12B:
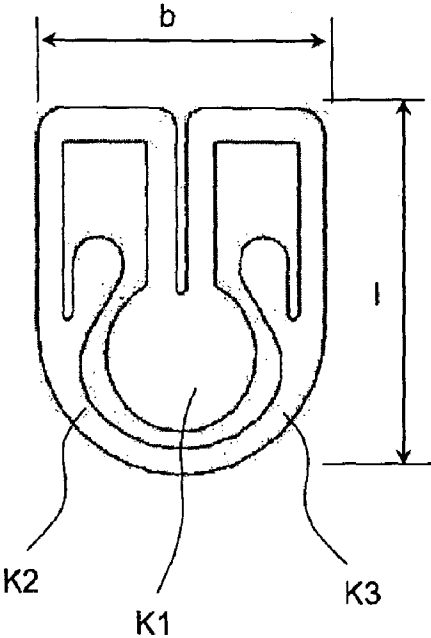

The embodiment according to FIG. 12*b* differs from the variation according to 12*a* in particular by the fact that the two clamping legs K2, K3, in an area in front of the head of the leg K1, are connected with each other. This provides as against the variation with a tilt gap (FIG. 12*a*) a larger torsional stiffness of the clamping legs K2, K3. The clip according to FIG. 12*b* is designed so that its push-on length l is larger than the width of the clip b.

Figure 12C:
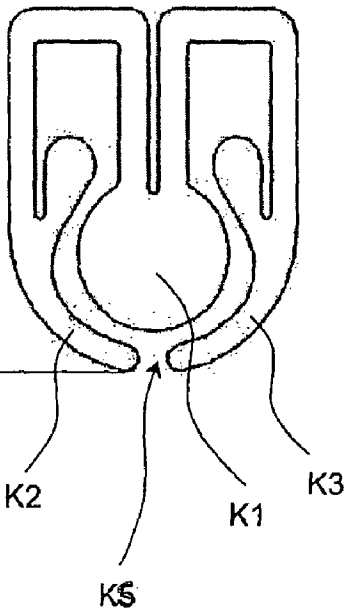
Figure 12D:
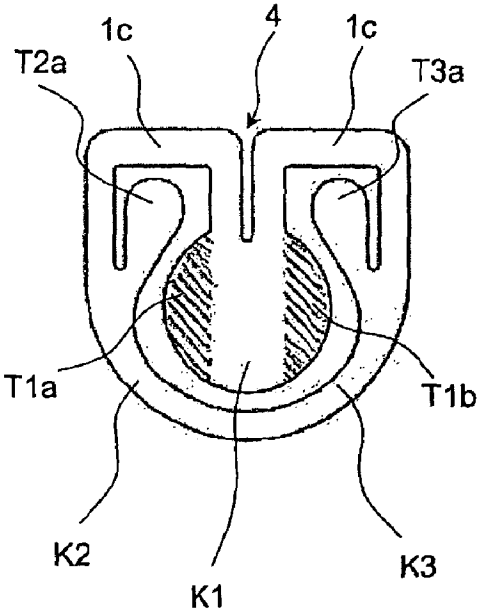

The clip according to FIG. 12*c* has similar proportions as the clip according to FIG. 12*b* and is provided similar to the clip according to FIG. 12*a* in the area of the front end of the clamping leg K1 with a tilt gap KS, by which the clamping legs K2, K3 are separated from each other.

The variation according to FIG. 12*d* differs from the variation according to FIG. 12*a* in the depth of the separation area 4. In this embodiment the depth of the separation area 4 is smaller than in the embodiment according to FIG. 12*a*, whereby the clip becomes stiffer with respect to the bending off of the bridge portions 1*c*.

Figure 12E:
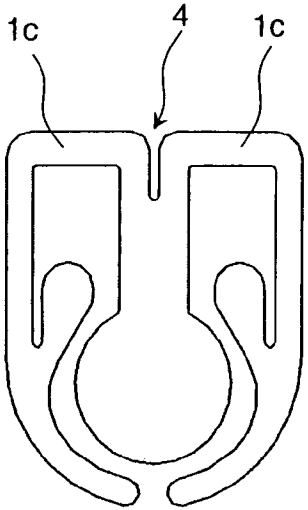

The variation according to FIG. 12*e* substantially corresponds to the variation according to FIG. 12*c*, whereby, here too, the separation area 4 is shorter than in the foregoing variation, so that the bridge portions 1*c* are stiffer propped than in the variation according to FIG. 12*c*.

Figure 12F:
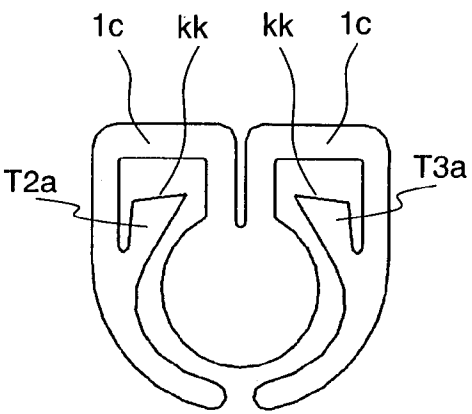

The embodiment according to FIG. 12*f* substantially corresponds to the variation according to FIG. 12*a*. It differs from the latter in respect to the shape of the torsion support flanks T2A, T3A, which in this embodiment form claw edges kk, which are apart from an inner edge of the always adjacent bridge portion 1*c* by about 20% of the push-on depth of the flat clip element. The claw edges kk are pushed, under the effect of the release moment generated by the bridge portions 1*c*, on the adjacent paper area and thereby positively prevent the flat clip element according to the invention from gliding off against the push-on direction.

Figure 12G:
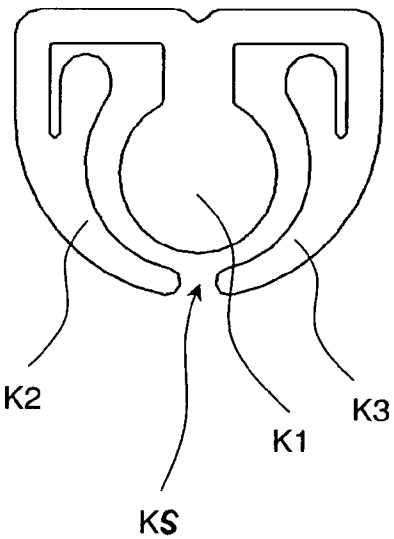

FIG. 12*g* depicts a flat clip according to the invention also with clamping legs K2 or K3 straddling like an arch the central clamping leg KS under the load of a tilt gap KS whereby said flat clip element is dimensioned so that its width transversely to push-on direction is larger than the length in push-on direction.

Figure 12H:
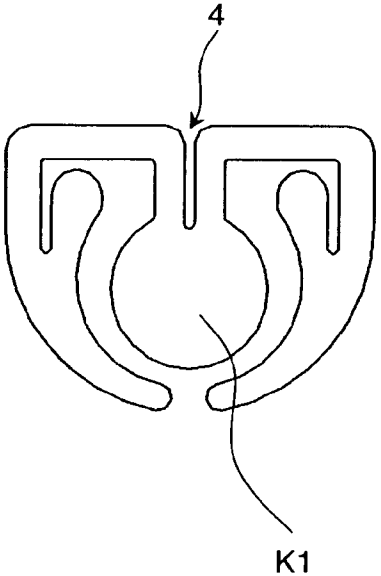

The flat clip element depicted in FIG. 12*h*, substantially corresponds to the flat clip element according to FIG. 12*g*, however, is provided with a separation area 4 extending deeper into the central clamping leg K1.

Figure 12I:
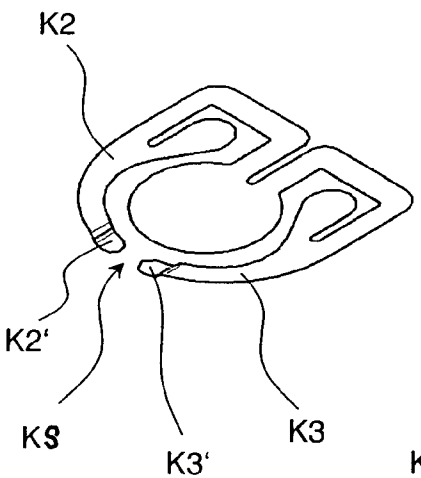

FIG. 12*i* is a perspective view of a flat clip element which in its construction substantially corresponds to the flat clip element according to FIG. 12*a*, however, is additionally provided with locally crimped end tongue section K2', K3' in the area of the ends of the clamping legs K2, K3, adjacent to the tilt gap KS.

Figure 12J:
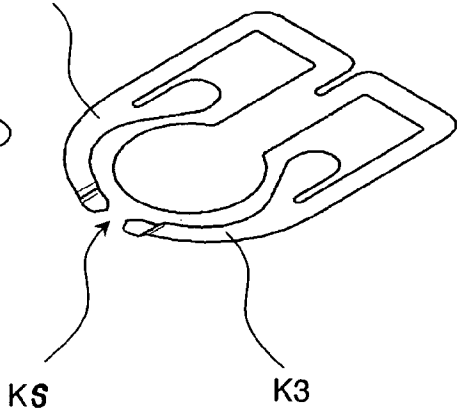

The embodiment according to FIG. 12*j* substantially corresponds to the variation according to FIG. 12*e* and similarly to the variation according to FIG. 12*e* is provided with locally crimped portions between the legs K2, K3 in the area of the tilt gap KS.

Figure 12K:
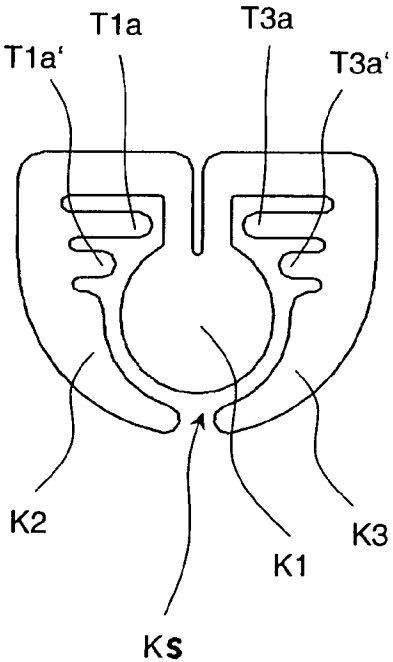

FIG. 12*k* depicts an embodiment of a flat clip element according to the invention with several torsion support flanks T1A, T3A, T1A', T3A' provided always at the respective outer clamping leg K2, K3, and with clamping legs K2, K3 straddling in an arch form the head section of the central clamping leg K1 by maintaining a tilt gap KS.

Figure 12L:
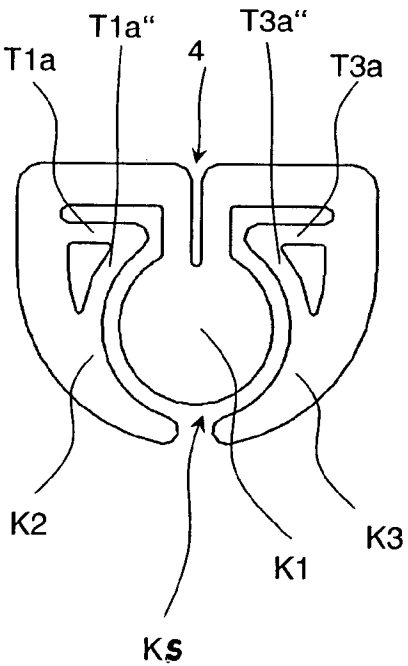

FIG. 12*l* depicts a variation of a flat clip element according to the invention, in which the clamping legs K2, K3 are also straddling a circular head section of the central clamping leg K1 by maintaining a tilt gap KS, whereby the torsion support flanks T1A, T3A are connected to the central area of the clamping legs K2, K3, seen in push-on direction, by a bridging section T1A", T3A" running along the central clamping leg K1 by maintaining a small gap. The separation area 4 extends here from the outer area into the inner area of the clamping leg K1 at a length of about 30 to 50% of the push-on depth of the clip element.

Figure 12M:
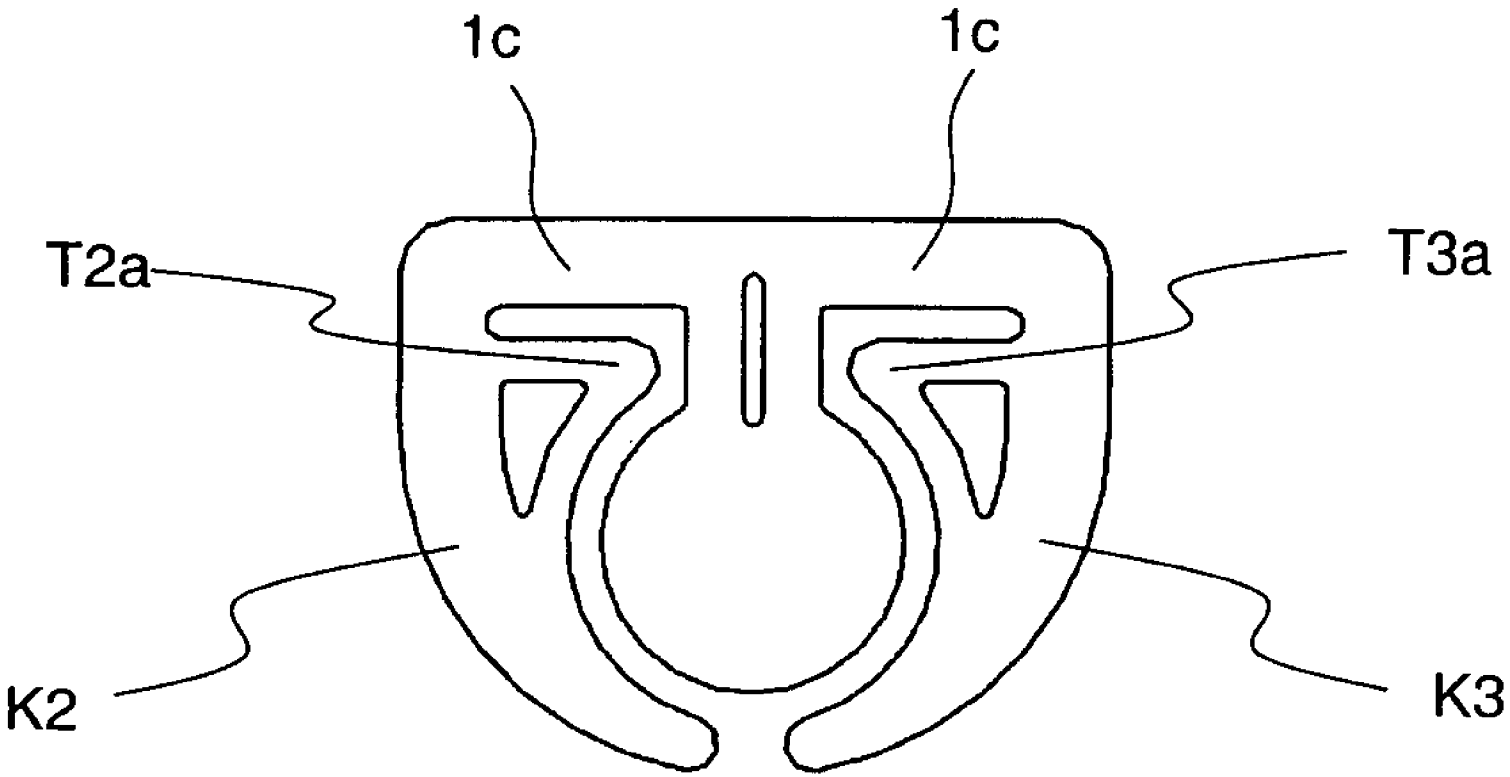

FIG. 12*m* depicts an embodiment of the clip element which substantially corresponds to the variation according to FIG. 12*l*, however, without a separation area 4 in the area of the bridge portions 1*c* so that the rear edge of the flat clip element has an greater flexural strength.

FIG. 13*a* is a profile sketch to illustrate a twelfth embodiment of an flat clip according to the invention with altogether four locally bent leg portions K1, K1', K2, K3. The clamping legs are also locally crimped upwards and downwards at crimp areas L1*a*, L1*b*, L1*c*, L1*d*, L1*b*', L1*c*' to the adjacent paper surface.

FIG. 13*b* is a profile sketch to illustrate a thirteenth embodiment of the flat clip according to the invention with altogether five locally crimped leg portions K2, K1, K23, K1', K3, which rest in application position alternatively on the upperside or underside of the paper. The center leg portion K23 is provided with a longitudinal crease S2. The side clamping legs K2, K3 are provided with torsion leg zones T2*b*, T3B at the head portion.

FIGS. 14 to 18 are two-legged embodiments of the holding clips according to the invention.

Figure 14:
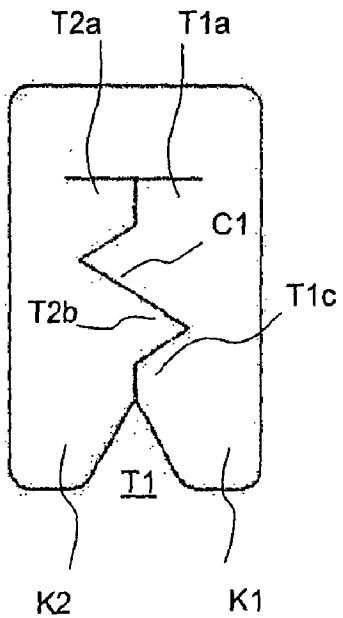
FIG. 14 is a profile sketch to illustrate a fourteenth embodiment of a flat clip according to the invention with merely two leg portions separated from each other by a zigzag separation area.

FIG. 14 is a profile sketch to illustrate a fourteenth embodiment of a flat clip according to the invention with merely two leg portions K1, K2 separated from each other by a zigzag separation area C1. The said leg portions K1, K2 are provided with several torsion leg zones T2*a*, T1*a*, T2*b*, T1*c*. At the head portion of the two leg portions K1, K2 is defined a push-on funnel area T1, allowing a simple manual push-on of the clip element onto the paper stack, when the clip element is at first held traverse to the paper stack.

Figure 15:
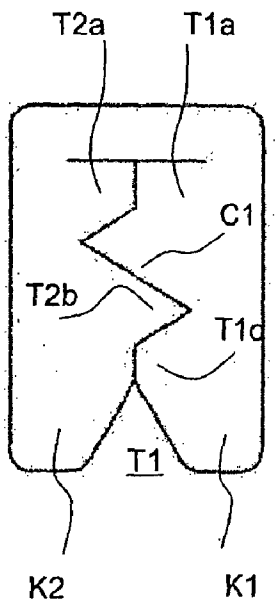
FIG. 15 is a profile sketch to illustrate a fifteenth embodiment of a flat clip according to the invention with two leg portions separated from each other by a zigzag separation area.

FIG. 15 is a profile sketch to illustrate a fifteenth embodiment of a flat clip according to the invention with two leg portions K1,K2 separated from each other by a zigzag separation area C1. The said leg portions K1, K2 have several torsion leg zones T2*a*, T1*a*, T2*b*, T1*c*. At the head portion of the two leg portions K1, K2 is defined a push-on funnel area T1, allowing a simple manual push-on of the clip element onto a paper stack, when the clip element is at first held traverse to the paper stack.

Figure 16:
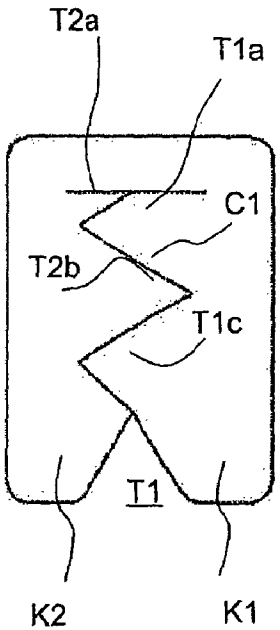
FIG. 16 is a profile sketch to illustrate a sixteenth embodiment of a flat clip according to the invention with two leg portions separated from each other by a zigzag separation area.

FIG. 16 is a profile sketch to illustrate a sixteenth embodiment of a flat clip according to the invention with two leg portions K1, K2 separated from each other by a zigzag separation area C1. Said leg portions K1, K2 have several torsion leg zones T2*a*, T1*a*, T2*b*, T1*c*. At the head portion of the two leg portions K1, K2 is defined a push-on funnel area T1, allowing a simple manual push-on of the clip element onto the paper stack, when the clip element is at first held traverse to the paper stack.

Figure 17:
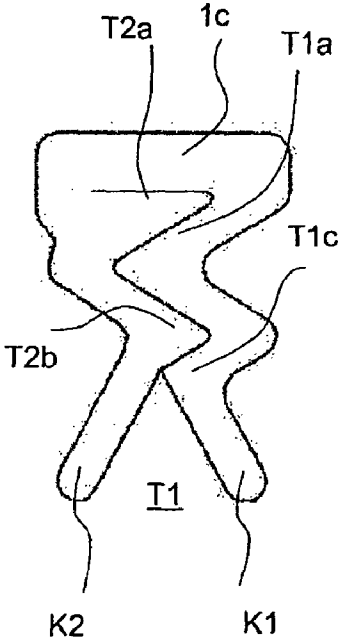
FIG. 17 is a profile sketch to illustrate a seventeenth embodiment of a flat clip according to the invention with two leg portions separated from each other by a zigzag separation area.

FIG. 17 is a profile sketch to illustrate a seventeenth embodiment of a flat clip according to the invention with two leg portions K1, K2 separated from each other by a zigzag separation area. The said leg portions K1, K2 have several torsion leg zones T2*a*, T1*a*, T2*b*, T1*c*. At the head portion of the two leg portions K1, K2 is defined a push-on funnel area T1, allowing a simple manual push-on of the clip element onto the paper stack, when the clip element is at first held traverse to the paper stack.

Figure 18:
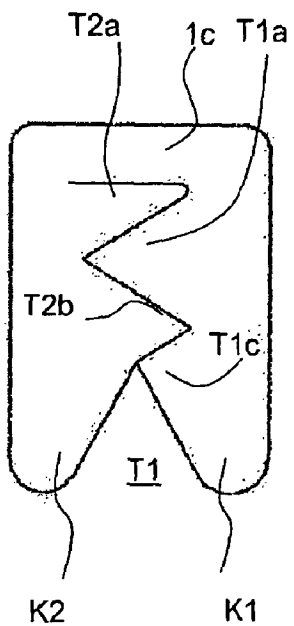
FIG. 18 is a profile sketch to illustrate an eighteenth embodiment of a flat clip according to the invention with two leg portions separated from each other by a zigzag separation area.

FIG. 18 shows a flat clip like the clip in FIG. 17, but the outer side walls are substantially linear.

FIG. 19*a* is a profile sketch to illustrate a nineteenth embodiment of a flat clip according to the invention based on the embodiment according to FIG. 7 with side legs K2, K3 locally crimped by crimp areas L1*a*, L1*d* close to the root of the legs and a partially longitudinally divided center leg K1.

FIG. 19*b* is a side view of the flat clip according to FIG. 19*a*. The leg portions K2, K3 are bent in application position in such a manner that the underside U of the clamping leg portions K2, K3 rests on a upper side of the paper stack and the upper side O of the clamping leg portion K1 rests on an underside of a paper stack.

FIG. 19*c* is a front view of the flat clip according to FIG. 19*a* with the leg portions K2, K3 to be elastically deformed and a bridge portion 1*c* in application position also torsionally loaded.

FIG. 19*d* is a perspective view of the flat clip according to FIG. 19*a* prior to attaching the same.

FIG. 20*a* is a profile sketch to illustrate a twentieth embodiment of a flat clip according to the invention based on the embodiment according to FIG. 7 with center leg K1 locally crimped close to the root of the leg. The length of the center leg K1 is dimensioned so that it projects in axial direction beyond the head portion of the adjacent leg portions K2, K3. This facilitates attaching the clip element by hand. The explanations with regard to FIG. 3*a* apply analogously to the features marked with reference numerals in this Figure and in the subsequent FIGS. 20*b*, 20*c*, 20*d*.

FIG. 20*b* is a side view of the flat clip according to FIG. 20*a* with the downwardly crimped center leg K1. FIG. 20*c* is a front view of the flat clip according to FIG. 20*a*, and FIG. 20*d* is a perspective view of the flat clip according to FIG. 20*a*.

Figure 21A:
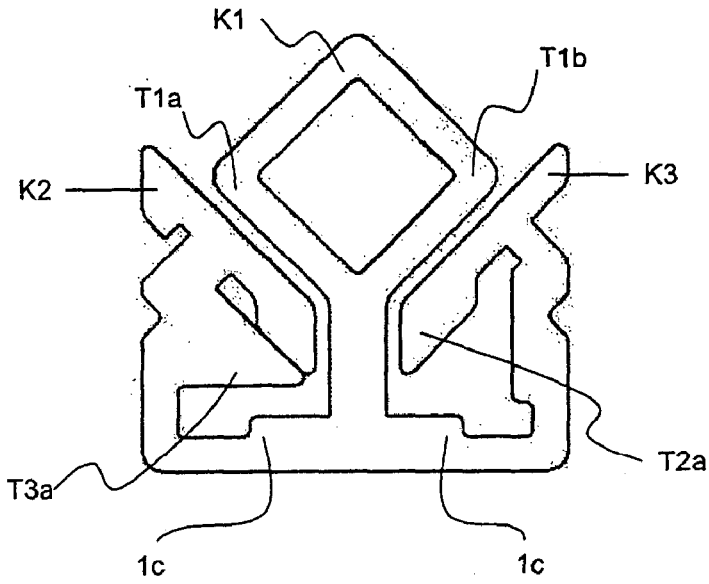
FIG. 21*a* is a profile sketch to illustrate a twenty-first embodiment of a flat clip according to the invention.

FIG. 21*a* is a profile of a twenty-first embodiment of a flat clip according to the invention. The flat clip comprises a bridge portion 1*c*, a center leg K1, and a first and second side leg K2, K3.

Figure 21B:
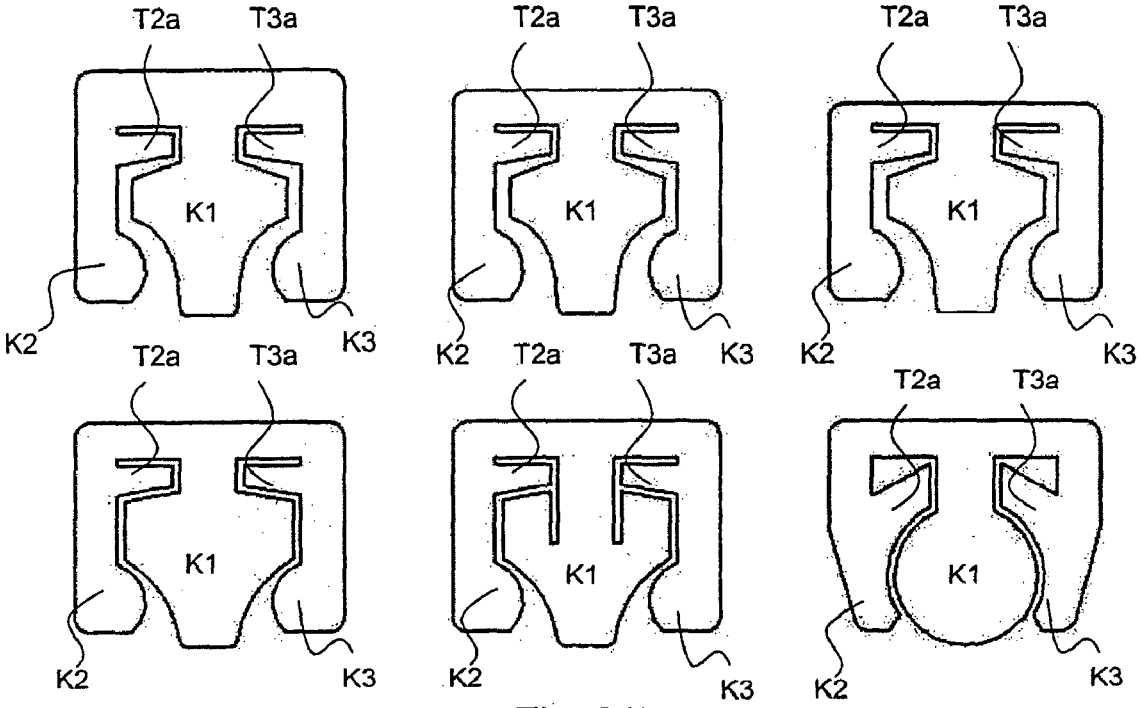
FIG. 21*b* are a series of profile sketches to illustrate further compact clips according to the invention with torsion leg zones provided at the side legs.

The above explanations apply analogously to the embodiments according to FIG. 21*b*, at least to the areas marked with reference numerals.

The invention also relates to and comprises wire clip elements in which the wire material has a course substantially following the outer profile of the flat clip elements described above and shown in the Figures. The invention comprises in particular also wire clip elements with torsion leg zones which close to the leg roots are designed, by the leg itself, as wire leg portions laterally bulging towards the adjacent leg.

According to the invention said wire clips may be compiled to a clip element stack.

The application device according to the invention is preferably designed so that it allows the application of clip elements manufactured out of a flat material or of a wire material.

The clips according to the invention are preferably characterized in particular by their clamping legs, in a top view on a clipping area or a main clipping plane, are designed adjacent to each other.

Figure 22A:
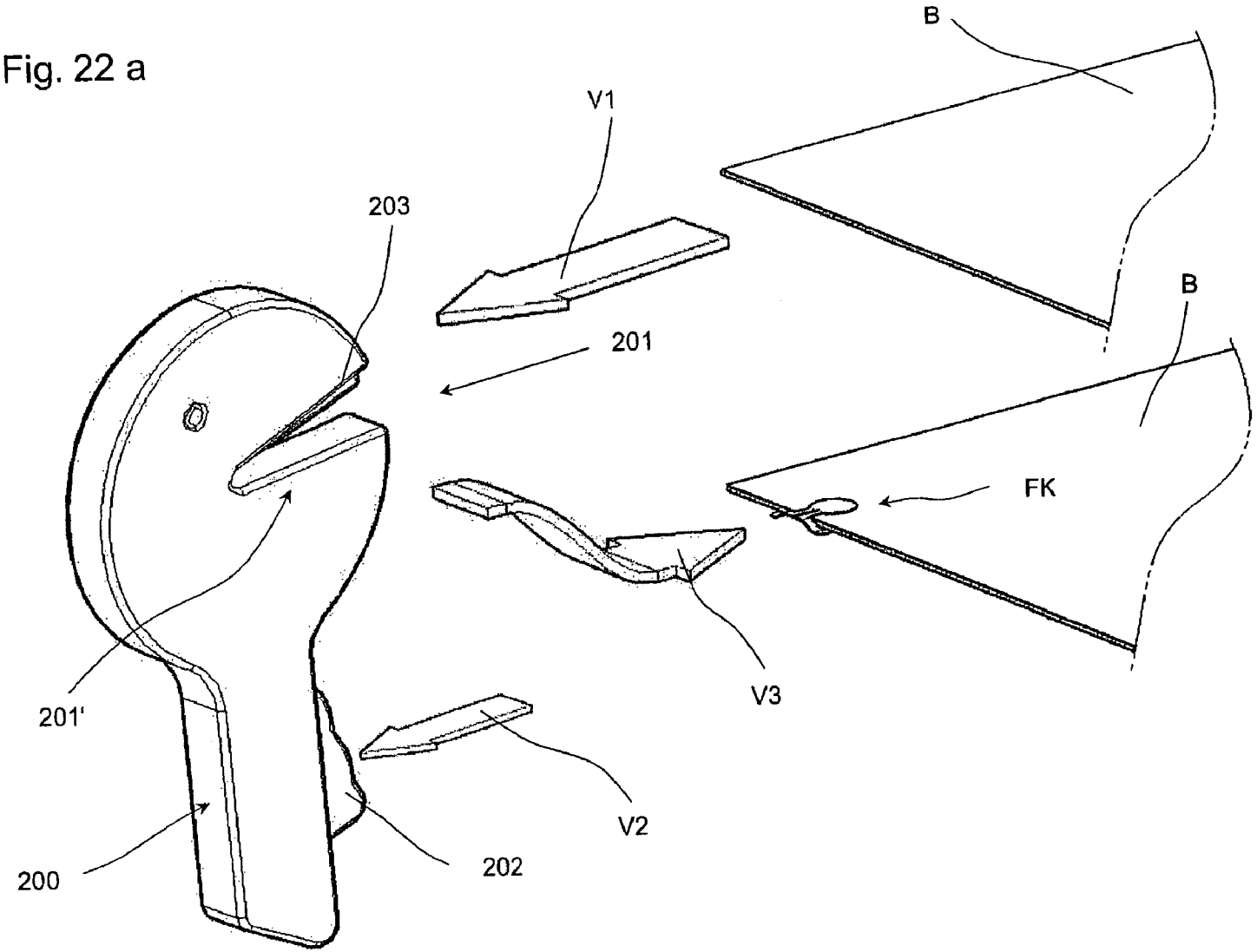
FIG. 22*a* is a perspective sketch to illustrate a manual applicator variation of the application device according to the invention.

FIG. 22*a* is a manual applicator for attaching flat clip elements according to the invention on a paper stack. The manual applicator comprises a receiving device provided in a hand area 200 of the same for receiving a clip stack formed out of flat material clips, a stopper device for determining an end position of the clip stack, a separator device for separating the front most flat material clip, a spreader device for expanding the respective clip in such a manner that in a flat clip element expanding step the clip is expanded to a degree that an entry edge of a clipping gap defined between the first and the second portion of the flat material clip is opened wide enough so that the clip may be placed on the object, and a release device for releasing the clip so that the first portion as well as the second portion rest on the respective surface of the object facing the clips.

The receiving device is designed as a guide housing. In the receiving device is provided a pusher device for pushing the clip stack against the stopper device. The stopper device is coupled with the receiving device.

The stopper device is part of the separator device. The separator device is provided with a ram element. For guiding the ram element there is provided a ram guide device.

The described manual applicator functions as follows:

At first a paper stack B is aligned to the edges and pushed into a receiving mouth 201 of the hand applicator until the receiving mouth 201 overlaps the paper stack at a position provided for attaching a flat clip element. As shown by the arrow symbol V1, the paper stack B is pushed in until it reaches a stop edge 201' of the receiving mouth 201. Now the actuator 202 is actuated by hand.

In actuating the actuator 202 a depressing device 203 is first lowered onto the paper stack B, so that the paper stack B is pinched and squeezed in the receiving mouth.

In the further actuating of the actuator 202 (arrow symbol V2) a flat clip element (see in particular FIG. 3*a*) is pushed off the clip element stack (see in particular FIG. 3*c*) by an application mechanism (see FIGS. 1 to 2*b*), received in the hand area 200, expanded and attached on the clipped paper stack.

Now the actuator 202 is released and the stack depressing device 203 is lifted.

The paper stack B can now, as indicated by the arrow symbol V3, be taken out of the receiving mouth 201. The paper stack B is now provided with an initially highly compact, stack-like stored flat clip FK.

Figure 22B:
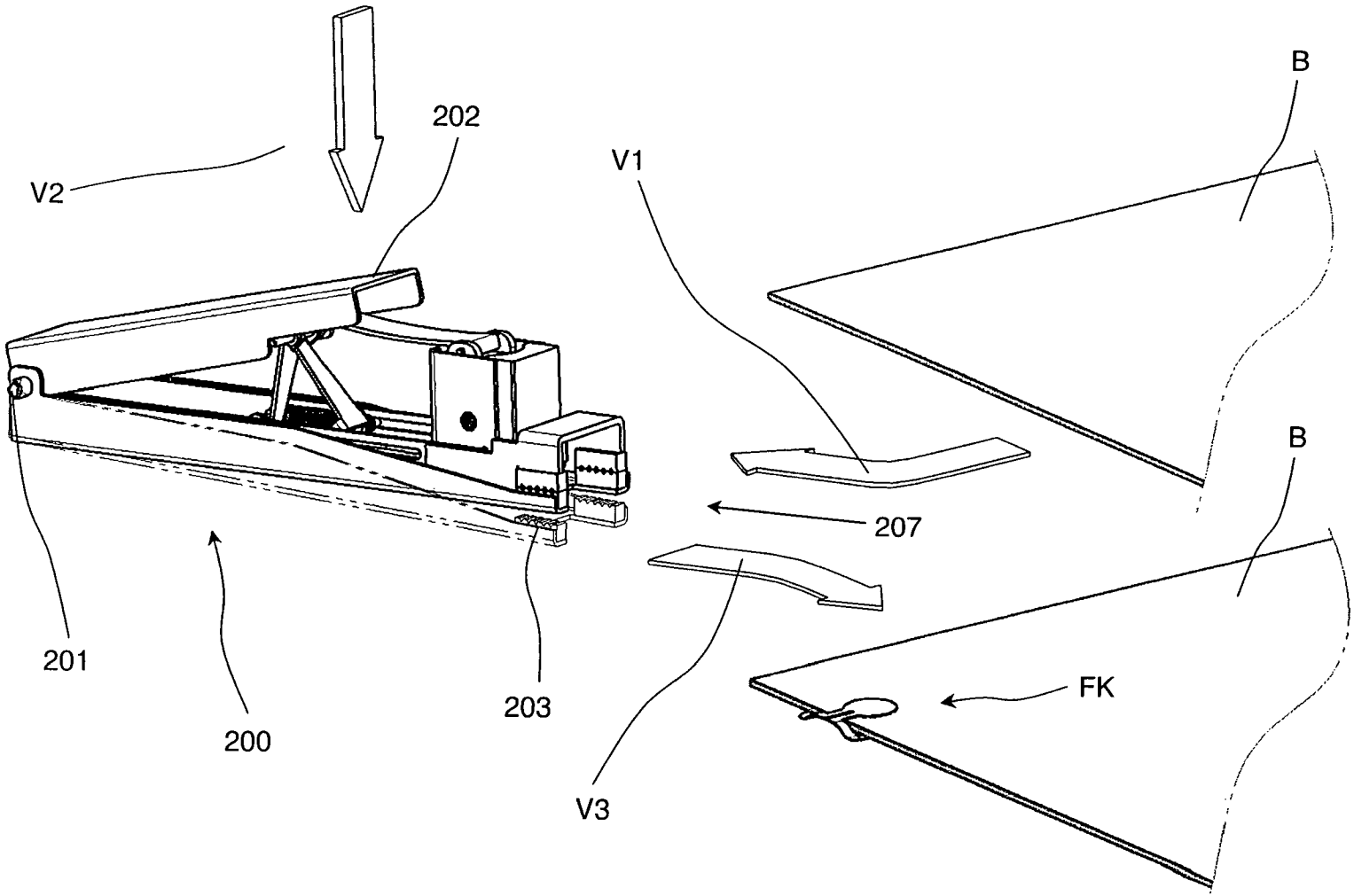
FIG. 22*b* is a perspective sketch to illustrate main components of a desk top variation of the application device according to the invention.

FIG. 22*b* depicts a desk top variation of a flat clip element applicator according to the invention. The explanations with respect to FIG. 22*a* apply analogously.

Figure 23A:
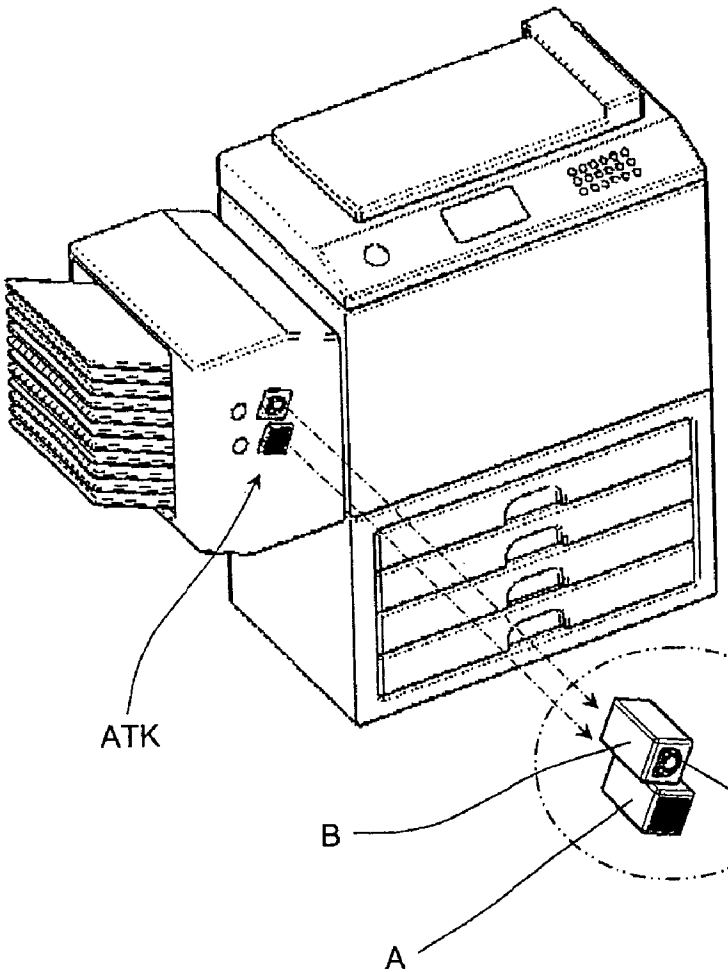
FIG. 23*a* is a design layout to illustrate a paper processing device with modular insertable wire clip or holding clip receiving modules.

FIG. 23*a* depicts a paper processing device, in particular a printer with a device (finisher) for generating a paper stack and a device for the application of a holding organ holding together the paper stack, whereby the device for the application of the holding organ is provided with a receiving structure ATK for receiving an application module B, and the application module B is provided with a device or components thereof for attaching a flat clip element FK on said paper stack.

The application module B may be constructed according to the application device described above in connection with FIGS. 1 through 2*b*, whereby actuation of the ram element is effected by electromechanical structure.

The receiving structure ATK may be designed in such a manner that alternatively to said flat clip application module B it may receive a wire clip application module A, for the application of wire clips HK penetrating the paper stack.

Figure 23B:
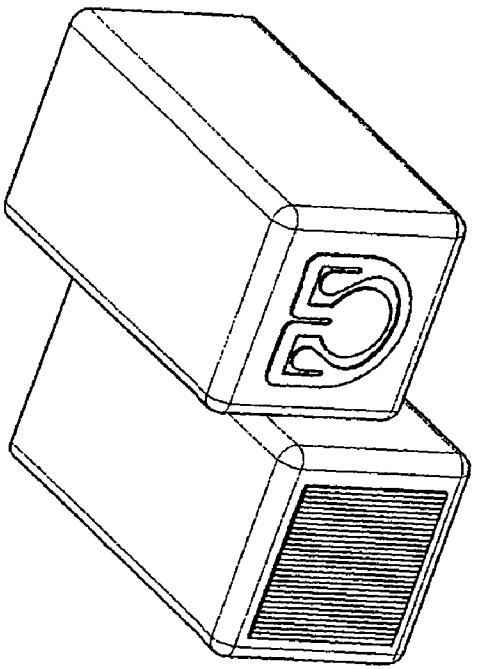
FIG. 23*b* are examples for storage modules for holding clip elements and wire clip elements.

The two modules designed for instance as magazine feeders, are shown in FIG. 23*b*.

The device may be designed in such a manner that the two modules may be installed simultaneously and be selectively actuated, e.g., by keys or menu structures.

It is possible to design the paper processing device in such a manner that a document batch comprises blocks connected to each other by flat clips or wire clips and such blocks may be connected by selected block forming means in the same way as the said flat clip elements or wire clips. To this purpose preferably sufficiently large gaps are provided between the application positions of the block forming elements, so that they may be alternately used within a set. It is also possible to design the device in such a manner that the flat clip element may be additionally fixed through said wire clips penetrating the paper stack.

Figure 24A:
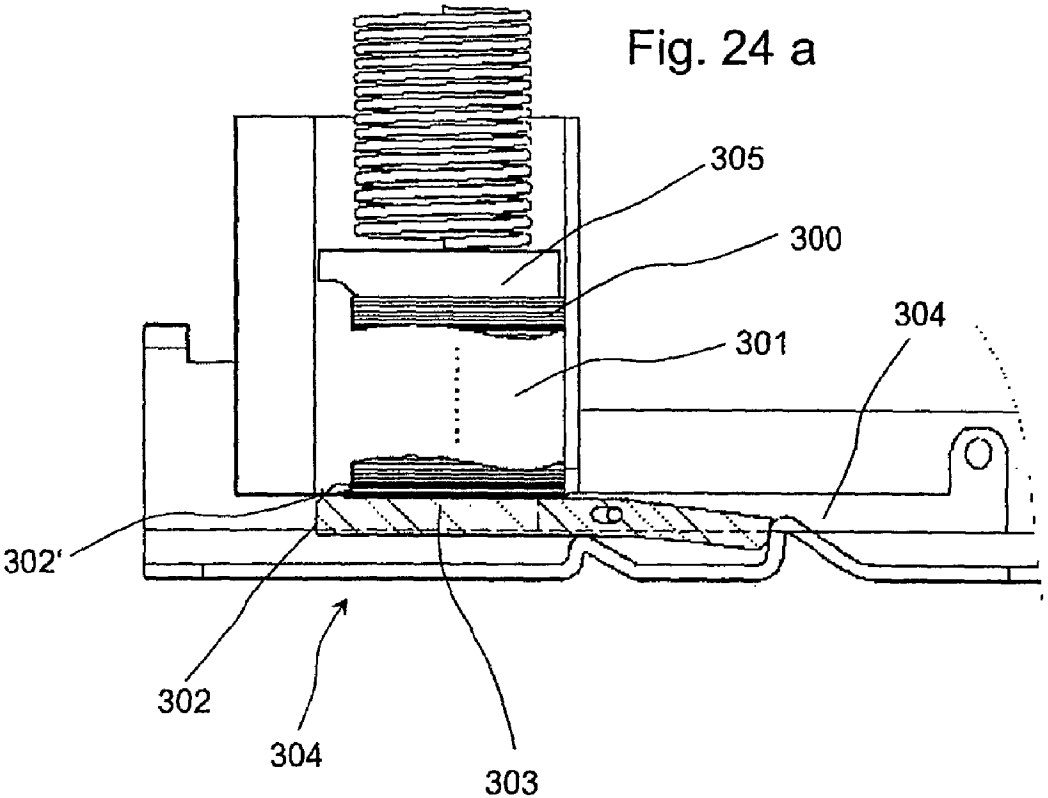
FIG. 24*a* is a basic sketch to illustrate a clip dispenser in which the clips are expanded by means of a pivoted claw device for providing a sufficiently widened clipping gap so that they can then be further pushed off the stack.
Figure 24B:
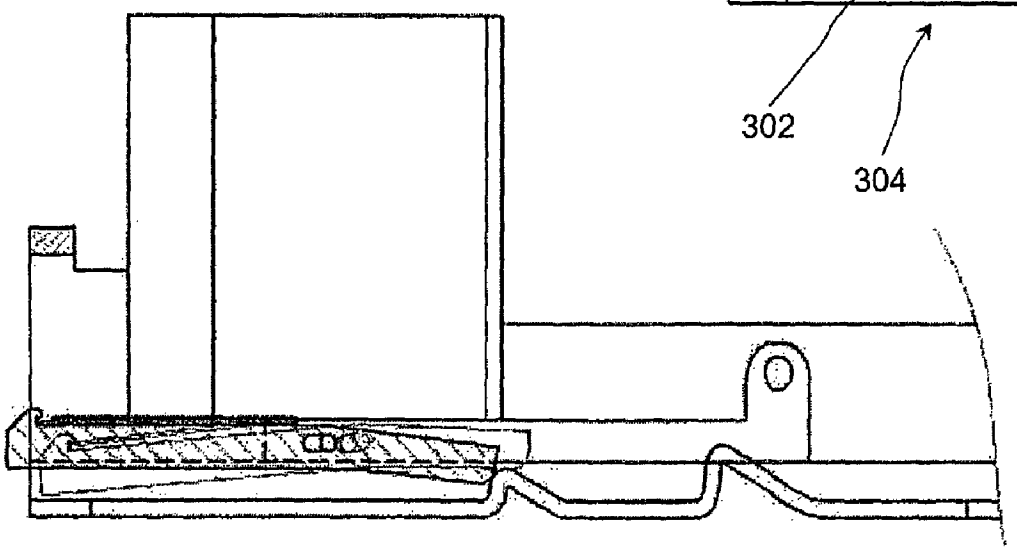
FIG. 24*b* is the dispenser according to FIG. 24*a* with a clip in an expanded condition.

FIGS. 24*a* and 24*b* depict an applicator with a receiving device 300 for receiving a clip stack 301 formed out of flat material clips, a stopper device for determining an end position of the clip stack 301, a separator device 304 for separating the front most flat material clip 303, a spreader device 302 for expanding the respective clip 303 so that it is expanded to such a degree that an entry edge of a clipping gap defined between a first portion and a second portion of the flat material clip is sufficiently opened so that the clip can be attached on the object, and the first and the second portion of the clip 303 rest on the surfaces of the object facing the clips.

The receiving device 300 is designed as a guide housing. The receiving device is provided with a pusher device 305, for pushing the clip stack 301 against the stopper device. The stopper device is connected with the receiving device.

The stopper device is part of the separator device 304. The separator device is provided with a pusher 304. For guiding the pusher 304 there is provided a pusher guiding device. The clipping operation is effected for example in the following steps:

1) The pusher travels forward (e.g., 3 mm) pushing the lower most clip 303 into the bow 302' (step 1)

2) Bow 302 tips the end of the clip (tongue moves downwards to the stopper of the bow)

3) Paper is introduced into the now expanded clipping gap area;

4) a—bow travels on and presses against the stopper;

b—pusher pushes the clip out of the guide slot=clip is free.

Figure 25:
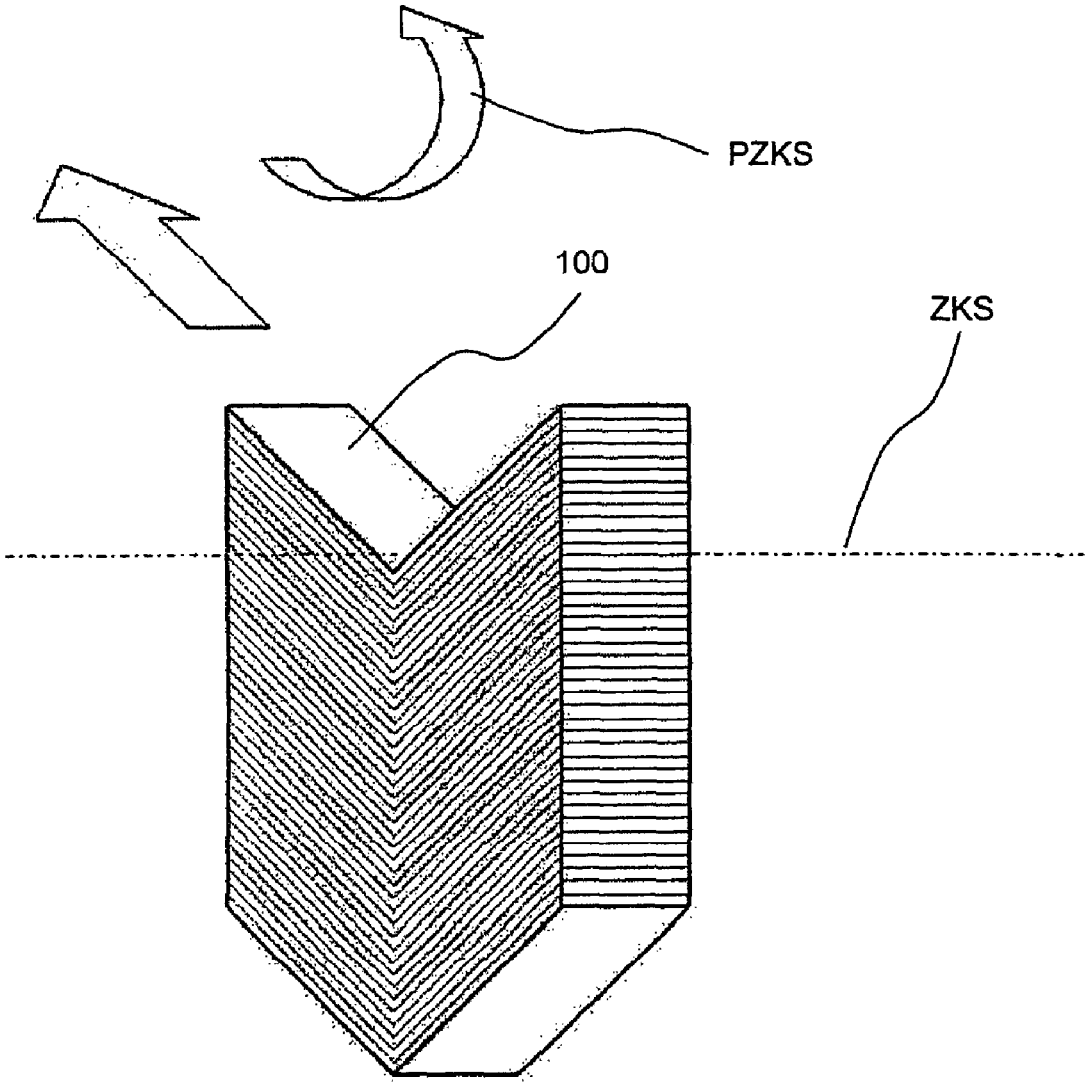
FIG. 25 is a further variation of a holding clip stack according to the invention with pre-crimped flat clip element base material sections.

FIG. 25 depicts a flat clip element stack with several flat clip elements 100 combined to a block, whereby said flat clip elements are 90° pre-bent in their center area, so that each flat clip element 100 of the stack is at first an angular element. For attaching the individual flat clip elements 100 the front most flat clip element 100 is pushed off the clip stack and at a second crimp section ZKS, indicated by the arrow symbol PZKS, adjusted to the thickness of the object to be clipped, in particular document stack, is once more crimped by 90°. The thus formed and attached flat clip elements are characterized by a particularly strong holding effect and a small projecting thickness in the area of the bridge portion 1*c*.

Figure 26:
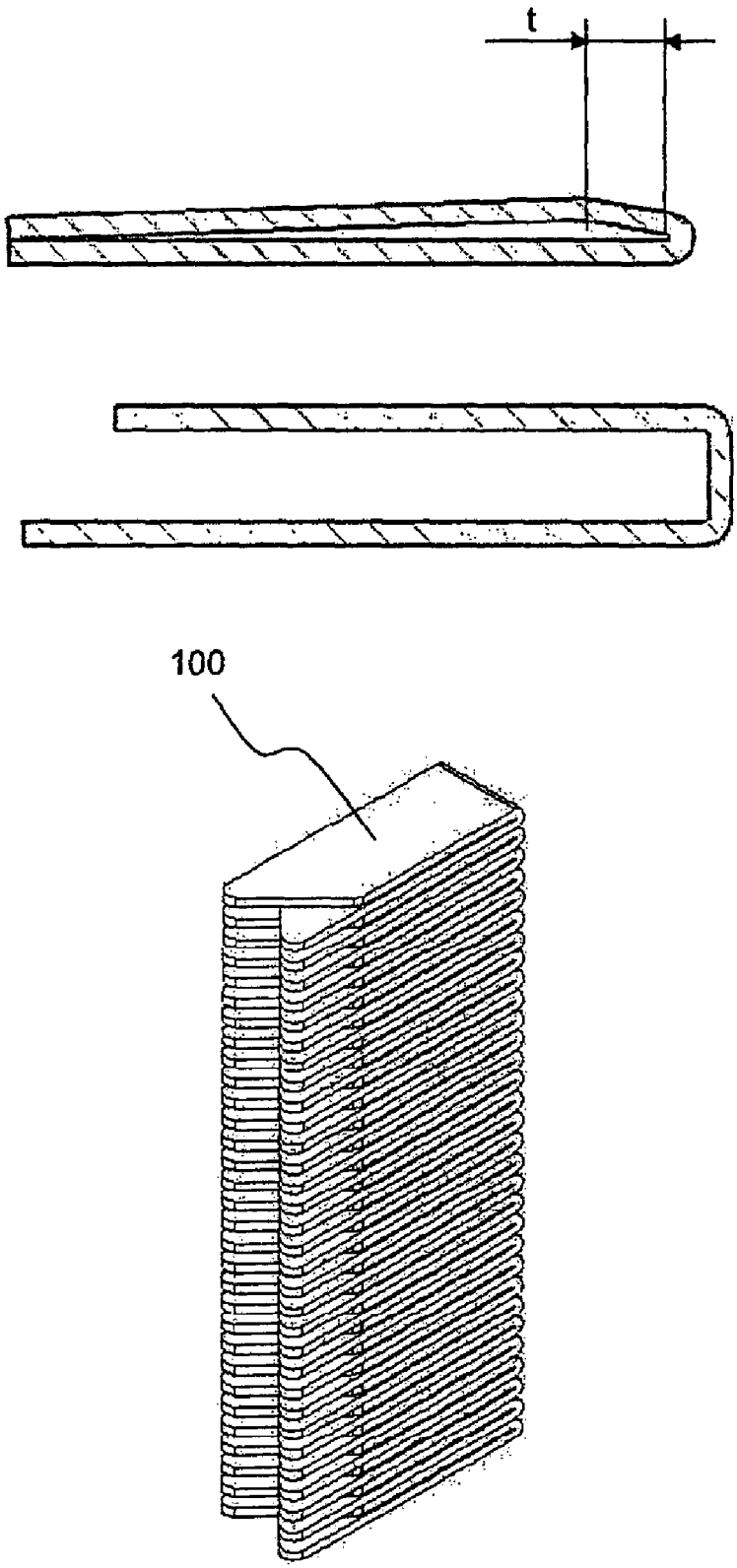
FIG. 26 is a further embodiment of a holding clip stack according to the invention with a pre-crimped and to be raised flat clip elements.

FIG. 26 depicts a further variation of a flat clip element stack with several flat clip elements 100, in which the individual flat clip elements are folded together relatively flat. It is possible to provide a respective application device in such a manner that the flat clip elements in their bridge portion 1*c* are at first expanded and additionally crimped according to the thickness of the document stack to be clipped.

Figure 27:
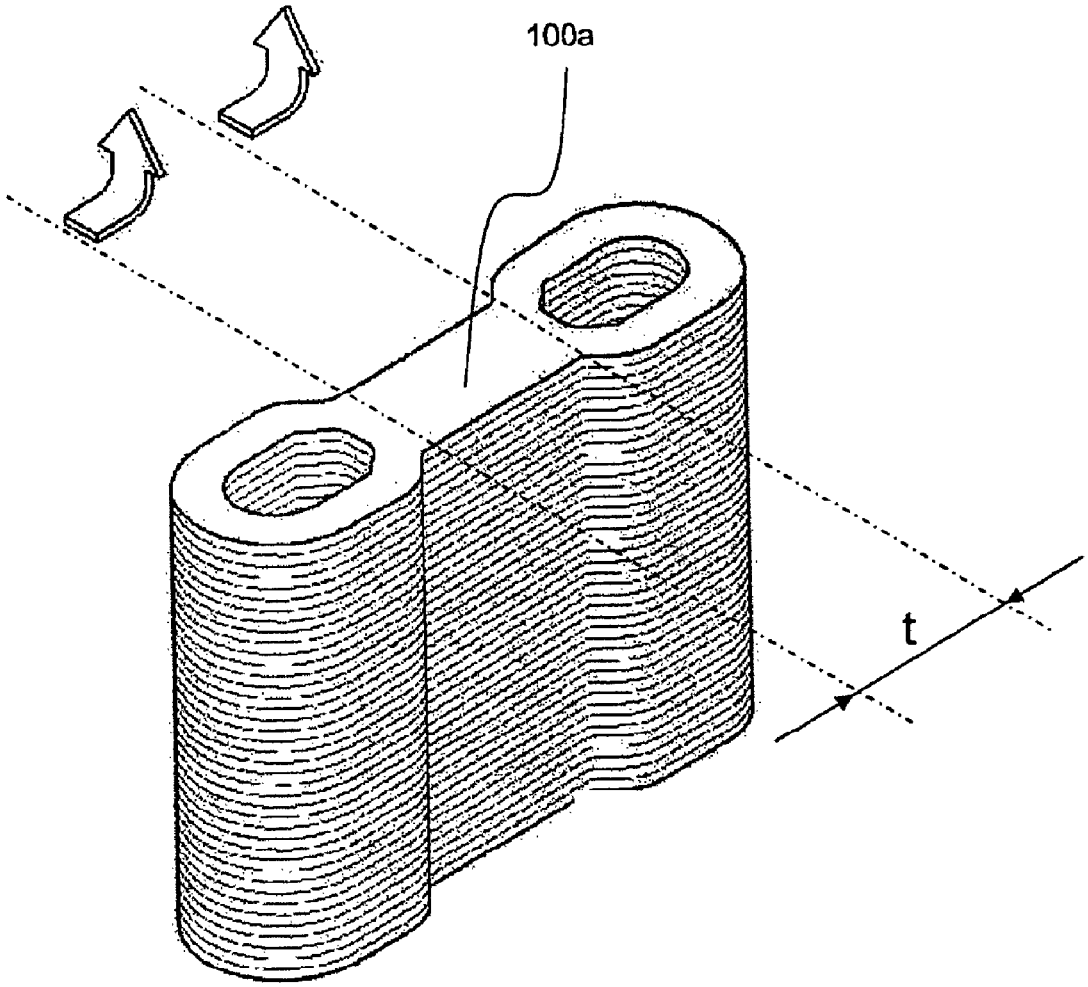
FIG. 27 is a further variation of a holding clip stack according to the invention with flat expanded, still un-crimped flat clip elements.

FIG. 27 depicts a flat clip element stack with flat and un-crimped flat clip element base sections 100*a*, whereby such flat clip element base sections are crimped twice by about 90° in their center area, thereby forming a clip surrounding a document edge. The position of the crimp portions, in particular the position of the crimp portions to each other may preferably be determined by the application device according to the thickness of the document stack to be clipped.

Figure 28:
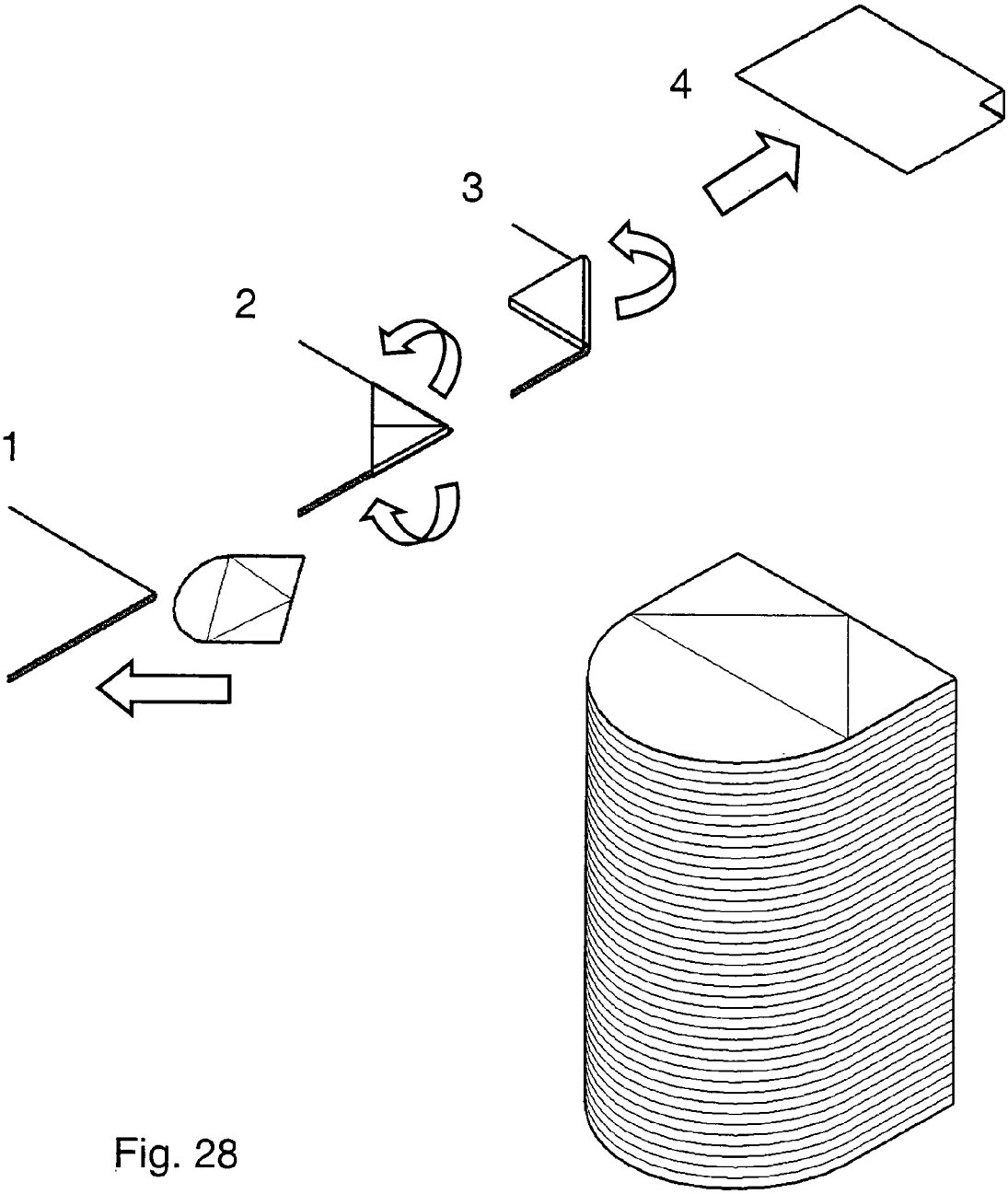
FIG. 28 is a further variation of a holding clip stack according to the invention with flat clip element base material sections designed as folding clips.

FIG. 28 depicts a clip stack formed out of numerous flat clip element base material sections connected with each other. Such base material sections may be mechanically attached by an application device to the edge, or in particular the edge area, of a document stack DS, not particularly shown here (step 1), and as shown in step 2 be folded down in the area of the projecting flanks (step 2). The edge area of the document stack DS thus surrounded by sections of the flat clip element can also be folded down by the application device, as is shown in step 3, so as to form a positively aggregated document stack, as shown in step 4.

Figure 29A:
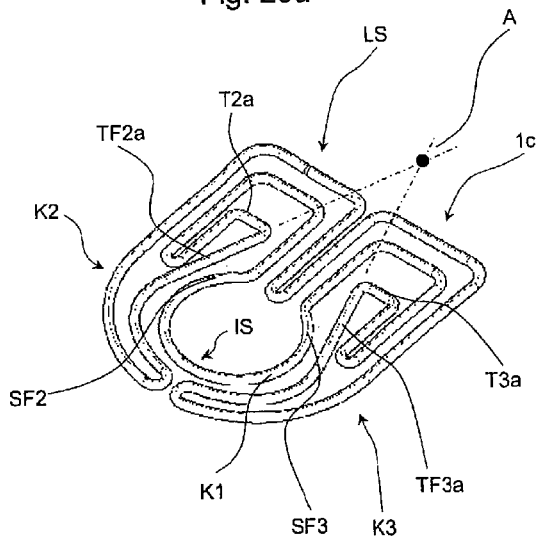
FIG. 29*a* is a holding clip manufactured according to another aspect of the present invention out of a material with a substantially circular material cross section or also out of a wire material.

The above explanations, in particular with regard to FIGS. 3*a* and 3*b*, analogously apply to the clip depicted in FIG. 29*a*. According to a particular aspect of the invention the depicted clip may be combined with other such clips to a clip stack (similar to FIG. 3*d*) and be attached by means of the described applicator systems as well as according to the described application method.

The clip shown may also be attached by hand. It is possible to design the application devices according to the invention in such a manner that they allow application of such round material clip as well as flat material clips.

The shown round material clip may be provided with a local welding area LS so that there are no open wire section. The welding area is preferably in the area of the bridge section 1*c* or at the internal tip area IS of the internal clamping leg K1. It is possible to connect adjacent leg sections, preferably in the area of bulging sections. It is possible in particular to connect the torsion legs T2*a*, T3*a* to the further flank areas of the outer clamping legs K2, K3. A particular feature of this clip and of the above described flat material clips is the fact that the clamping legs K2, K1, K3 defining the clipping area are arranged adjacent to each other.

The round material clip is provided with torsion legs T2*a*, T3*a* in the area of the root of the legs. Such torsion legs extend always inwards to the central center leg K1. In this embodiment the torsion legs T2*a*, T3*a* are designed in such a manner that they have flanks TF2*a*, TF3*a* which are inclined in push-on direction. Inclination of such flanks is effected in such a manner that an apex A, defined by said flanks and seen in push-on direction, are positioned behind the torsion legs T2*a*, T3*a* or on or behind the bridge section 1*c*, respectively.

As explained, it is possible to design flank sections SF2, SF3 also at the central clamping leg K1 in such a manner that they are spaced apart in interaction with the flanks T2*a*, T3*a* forming spacings substantially tapering towards the apex A. By means of such spacings it is possible, in particular with a thinner object to be clipped (in particular paper stacks with merely 2 to 12 sheets), to deform the object or paper stack locally in such a manner that there are created two bulging sections tapering towards each other under an arrow profile, whereby a stronger tensile resistance against push-off of the clip element is obtained. Such arrow profile block effect is actually also obtained with the flat clip elements according to FIGS. 3*a*, 3*b* and 4 to 6 and the flat clip elements according to FIGS. 12*a* to 12*m*.

The term "close to the root" in the present context refers, e.g., to the area of the legs extending from the bridge section over, e.g., about 47% of the length of the legs measured in push-on direction.

With the holding clips according to the invention manufactured out of a flat material as well as with those manufactured out of a wire material it is possible to obtain the linkage between the holding clips necessary to form a block unit by connecting structure, which after the respective holding clip has been detached from the block remain section-wise at the holding clip element and thereby can perform a secondary function. Such secondary function may in particular include in the making available of friction increasing or non-slip structures as well as colored areas. It is possible to provide openings, borings, loop sections, recesses or the like at the clip elements which, when in a block unit, are interspersed with connecting structure, in particular a silicon and/or a resin, e.g., a thermoplastic, to accumulate or bind the individual clip elements to such block unit. For instance a silicon string interspersing the block unit may on successive push-off of the respective holding clip element be sheared off in such a manner that a small disc section, the thickness of which corresponds to the thickness of the clip element measured in longitudinal direction of the block, remains in or at the holding clip element and if necessary provides an additional holding effect.

Non-slip structures may also be provided at the holding clip elements by other means. It is possible in particular to design knobs or webs raising with a lens-like cross section at the holding clip element whereby such elevations stick more strongly to their corresponding holding clip element than to the adjacent holding clip element. Such varying adhesiveness may be obtained by a respective surface treatment of selected zones of the respective holding clip element. The non-slip structures which can preferably also contribute to forming a block may in particular be provided by screen or stencil printing processes. In particular with holding clips out of a flat material it is possible to print these structures on the base material before punching.

Figure 29B:
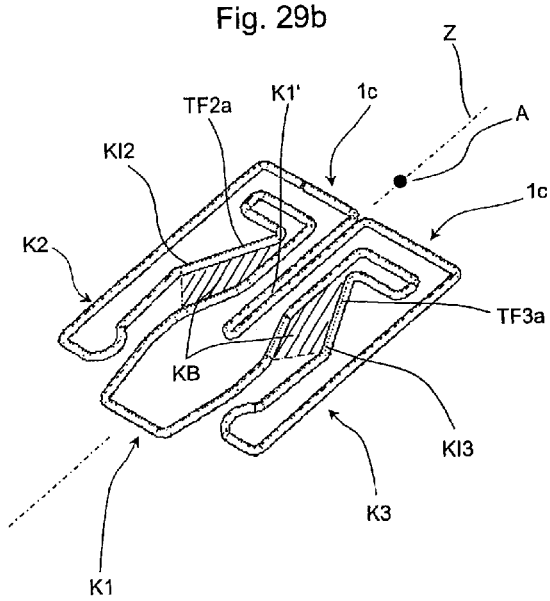
FIG. 29*b* is a further holding clip manufactured out of a material with a substantially circular material cross section and with respect to its profile corresponding to FIG. 3*a;*

FIG. 29*b* depicts a clip, similar to that according to FIG. 29*a*, manufactured out of a round material, in particular steel wire material. Said clip comprises a central clamping leg K1 and two side clamping legs K2, K3. Each of these clamping legs K1, K2, K3 comprises a pair of wire legs affixed in the area of the bridge sections 1*c*. At the inside wire legs K12, K13 there are provided flank sections TF2*a*, TF3*a* inclining in push-on direction and nose-like extending towards the central longitudinal axis Z, which in interaction with the adjacent flanks of the central clamping leg K1 define the wedge gap area KB tapering towards an apex A. Said flank sections TF2*a*, TF3*a* moreover form torsion legs provided in near the edge application position, functioning substantially in same way as the above described torsion legs T2*a*, T3*a* according to FIG. 3*a*.

In this embodiment there is moreover provided an inner leg K1' extending into the central clamping leg K1. The inner leg K1' may be selectively provided together with clamping leg K1 on the upper side of the object or also together with side leg structures K2, K3 on the underside of the object.

It is possible to provide the wire clip elements shown here with a coating or to mould them in a plastic material, so that in particular clip elements are created in which the internal area of the respective leg K1, K2, K3 is filled all-over.

Figure 30:
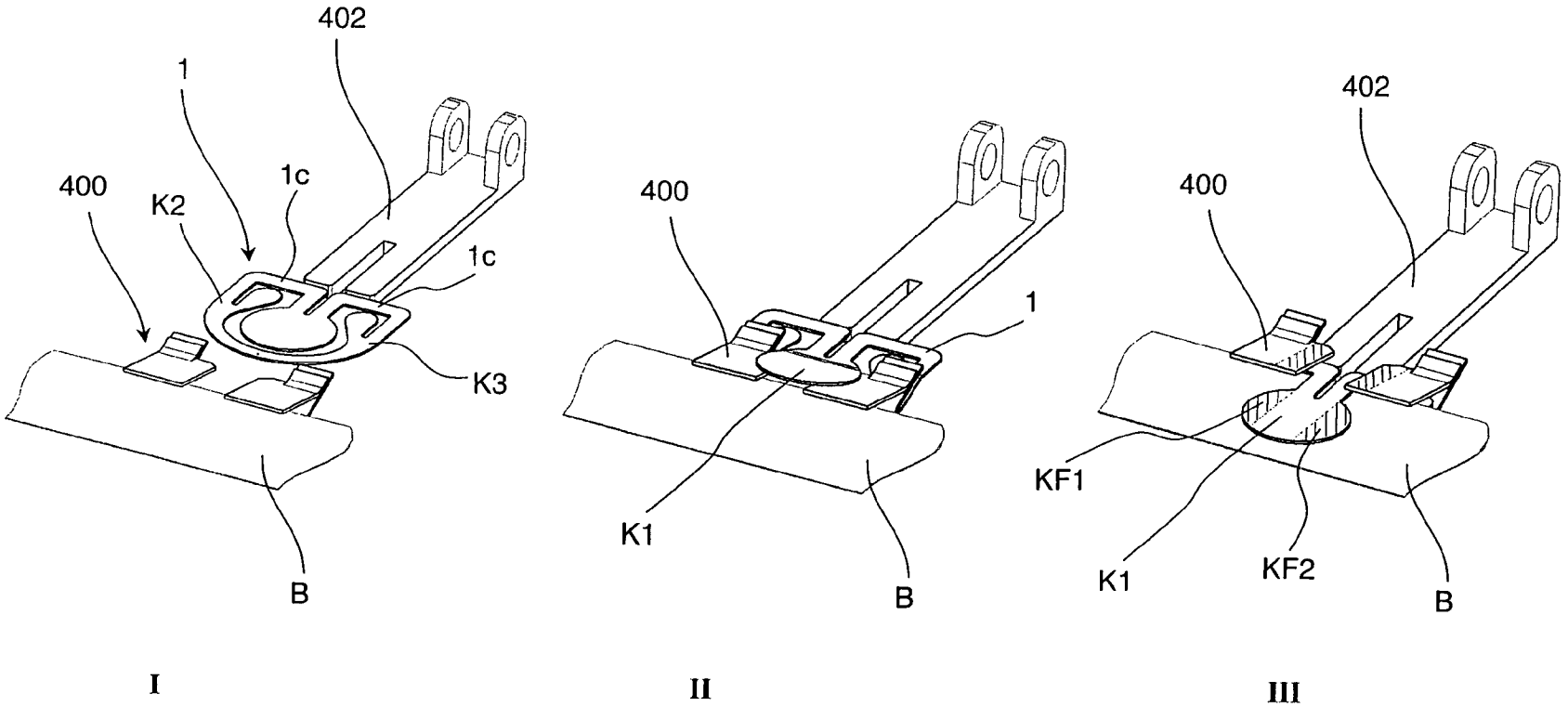
FIG. 30 is a diagrammatic view to illustrate the application of a clip element according to the invention with an elastic ramp device.

FIG. 30 shows three steps for the application of a flat clip element according to the invention as shown in FIG. 3*b* by using a preferably flexible ramp structure 400. The ramp structure is manufactured in this embodiment out of a spring steel material and is part of a guide unit by which the flat clip element 1 shown here can be pushed on a paper stack B over an application ram 402.

In step I shown here (in the left Figure) the flat material clip 1 is still positioned at the face side of a flat clip block not more particularly described here. The ram element 402 stands close to the back of a rear edge of the clip provided by the bridge sections 1*c*. The flat material clip 1 is pushed by the ram element 402 into the flexible ramp structure 400, as shown in step II. Thereby the laterally projecting head section designed at the central clamping leg K1 slides on guide areas provided by the flexible application ramp 400. The side clamping legs (see step I in the Figure) K2, K3 are drifted downwards by the flexible application ramp 400 and travel on the underside of the paper stack B on lower guide tongues, here not particularly recognizable, of the ramp structure. By the intrinsic elasticity of the clip element 1 or also by additional, here not more particularly described, structures it is possible to fold together or cushion the flexible application ramp, so that it pinches the paper stack B locally. Thereby on the one hand the paper stack B is held within the application device, not more particularly shown here, and on the other hand the flat clip element 1 is expanded only to such a degree as is necessary in order to push the flat clip element 1 onto the paper stack B.

During step III the head section of the central clamping leg K1 slides down from the upper guide area formed by the flexible application ramp 400, here dotted, and snatches directly onto the upper side of the paper stack B. The side clamping legs K2, K3 (invisible in this Figure) are now positioned on the underside of the paper stack B. It is possible to design a respective application device in such a manner that the paper stack, now provided with the flat clip element, in another step, is pushed out of the application device by the ram element 402.

In the embodiment depicted here the flexible guide structure 400 is designed so that it guides the laterally extended head section of the central clamping leg K1 onto the here visible upper side of a paper stack, while the side clamping legs K2, K3 run on the underside of the paper stack. However, it is also possible to design such flexible guide structure 400 so that the central clamping leg K1 runs on the underside of the paper stack and the side clamping legs K2, K3 on the upper side of the paper stack. The flexible guide structure 400 can be designed so that it forms a stopper area for the positioning of the front side of a clip element stack. The application ramp principle shown here, in which the central clamping leg runs along and is expanded at laterally projecting head flanks KF1, KF2 may also be applied in connection with similarly designed, but inflexible ramp structures.

Figure 31:
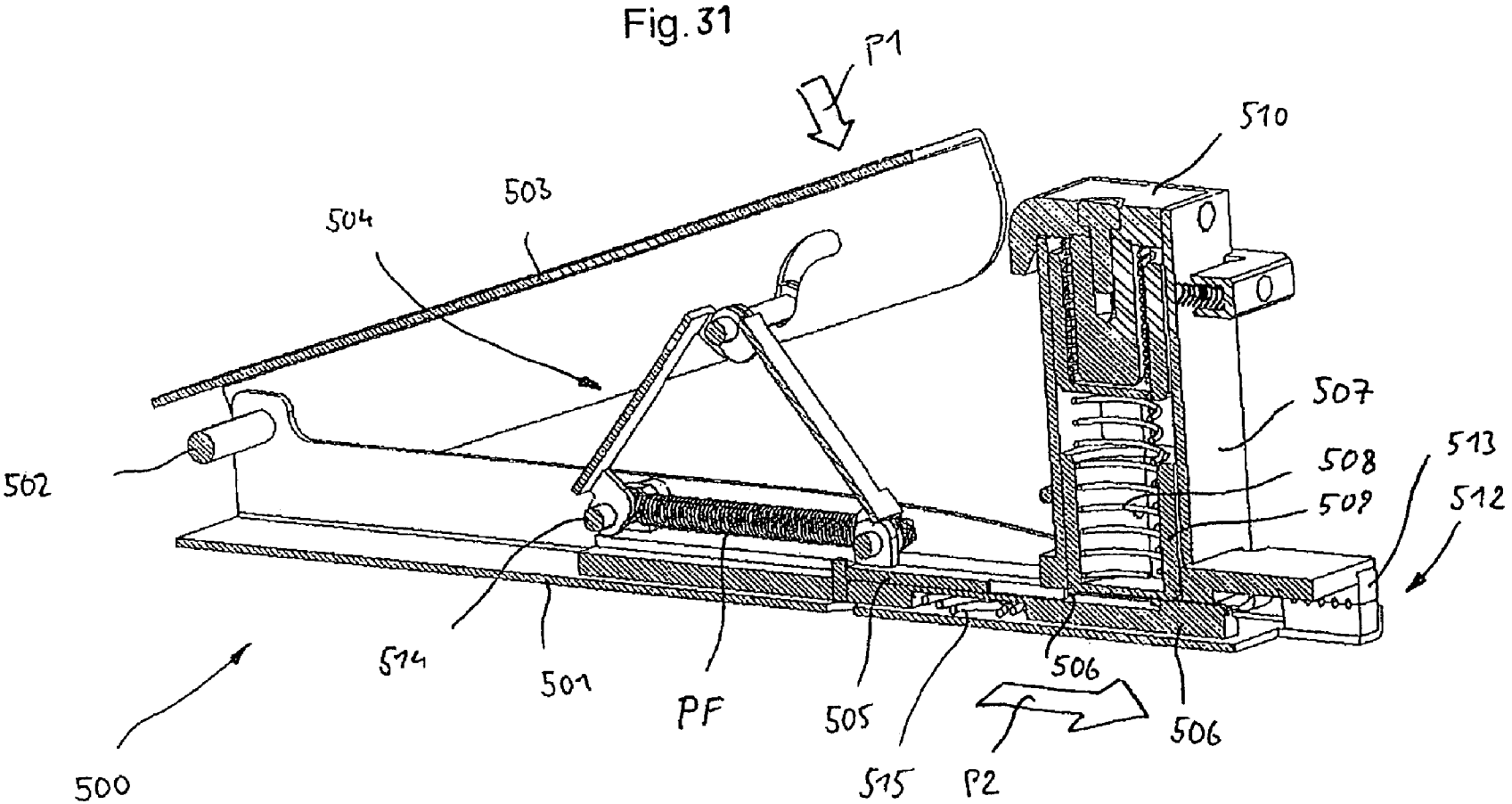
FIG. 31 is a sectional view to illustrate the construction of a further applicator according to the invention for extremely thin flat clip elements.

FIG. 31 is a longitudinal section of another embodiment of an application device for ultra thin (0.08 mm to 0.35 mm) and thereby especially tightly storable flat clip elements. The application device 500 shown here comprises a base plate 501 and an actuation handle 503 rotatably coupled with such plate over an axis 503. The base plate 501 and the actuation handle 503 are here coupled with an axial ram element 505 by a driving mechanism 504, here designed as a toggle mechanism. When the actuation handle 503 is pressed down according to the arrow symbol P1 said axial ram element 505 makes an axial swing in the direction of the arrow P2 against the pull-back force of a pull-back spring RF. The axial ram device runs in a linear guide device 506 in such a manner that a front engaging face area 506 of the axial ram element 505 can only push-off from a spring-loaded flat clip element stack, received in a clip feeding sleeve 507, one single flat clip element fed in by the clip feeding sleeve 507. The spring loading of the flat clip elements, here not particularly shown, received in the flat clip element sleeve 507, may be effected by a spring 508 loaded push member feedings means 509. When the flat clip feeding sleeve 507 is completely filled, the push member feeding means 509 is in the top-most position, as is depicted here for the purpose of illustration. The feeding of the flat clip element feeding sleeve 507 may be effected by the push member feedings means 509 being taken off the sleeve 507 together with the corresponding spring device 508 and a cover device 510. Into the now open sleeve there may be inserted a highly compact flat clip element stack, for instance consisting of 250 flat clip elements. Then the push member feeding means 509 is also inserted into the sleeve device 507 and spring-loaded propped by the cover device 510.

The application device depicted here includes a paper clipping mouth 512, here shown in a closed position. The paper clipping mouth may be opened by swinging open an upper jaw device 513, so that a respective paper stack may be put into the clipping mouth 512. In this embodiment said upper clipping jaw 513 can swing upwards around a pin 514 together with the sleeve device 507, whereby the clipping mouth 512 is opened. The opening of the clipping mouth 512 is moreover supported by a spring 515. Said spring 515 is dimensioned so that the clipping mouth 512, by the acting of actuation forces on the actuation handle 503, is first closed thereby pinching the introduced paper stack and the axial ram element 505 is actuated only thereafter. The flat clip element, pushed off by the axial ram element 505 from the clip stack stored in the sleeve device 507, is expanded by a, here not particularly recognizable, ramp structure, the functioning of which is illustrated in FIG. 33, and thereby pushed on the paper stack sufficiently fixed in the clipping mouth 512.

Figure 32:
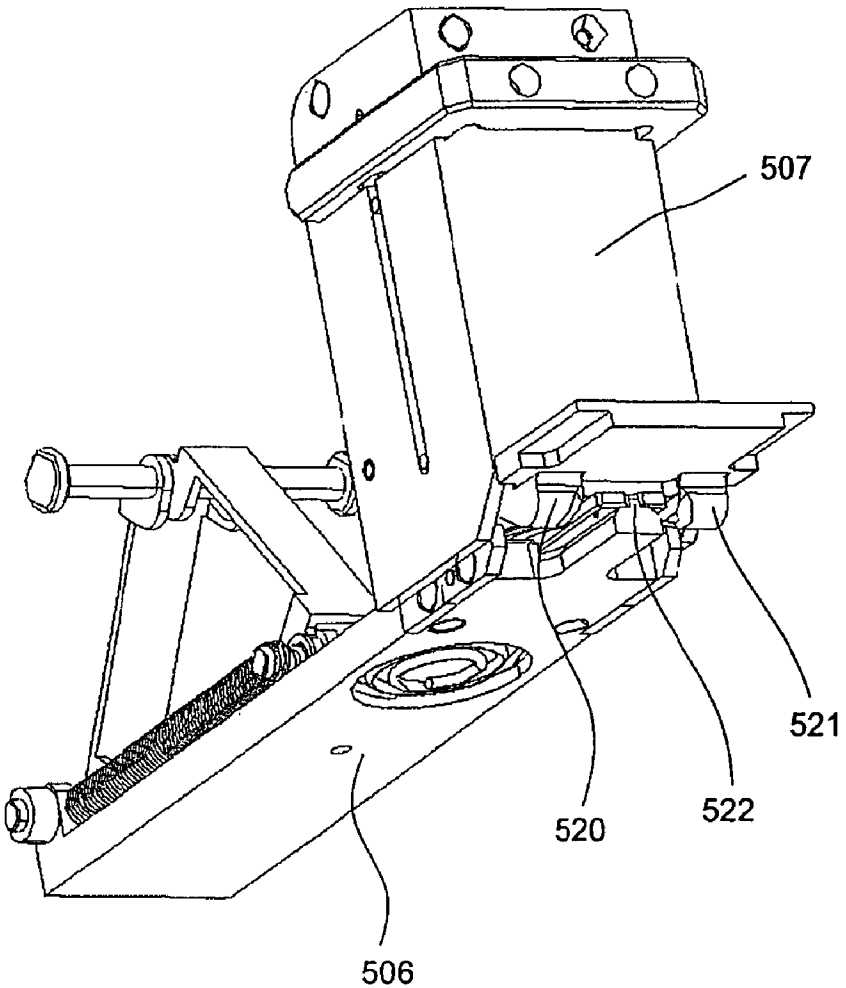
FIG. 32 is a perspective view to further illustrate the construction of the applicator according to FIG. 31.

FIG. 32 depicts the application device according to FIG. 31 without the base plate 501 provided in FIG. 31 and the actuation handle 503. In this illustration in particular the structures provided for the expanding of the flat clip element may be recognized. These structures comprise two ramp sections 520, 521, provided for deflecting the side clamping legs K1, K2 (FIG. 3*b*) and a guide web 522 for guiding the central clamping leg K1. The ramp sections 520, 521 are inflexibly coupled with the flat clip element receiving sleeve and the lower guide device 506. In the embodiment shown here the expanding or spreading required for pushing on the flat clip element is obtained by the central clamping leg, provided with a head section, running in a substantially straight direction through the central guide web 522 whereby during the movement of the head section on the central guide web 522 the side clamping legs K2, K3 (FIG. 3*b*) are deflected downwards by the ramp sections 520, 521.

Figure 33:
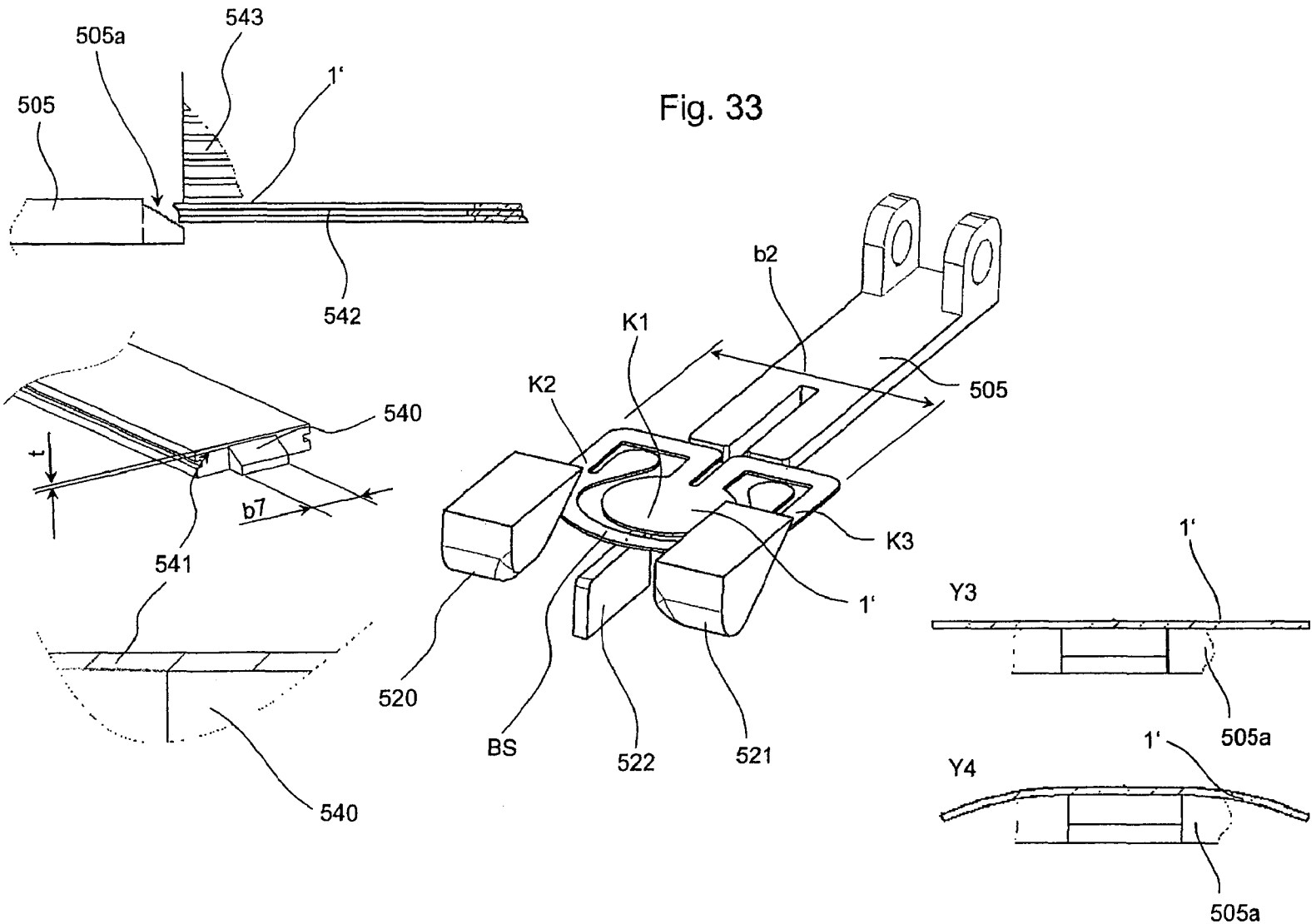
FIG. 33 is a diagrammatic view to illustrate the main components of an applicator head and the functioning thereof.

In FIG. 33 said deflecting sections 520, 521 as well as the central guide web 522 are separately shown. In the spreading means depicted here it becomes possible to slightly plastically deform the front bridge section straddling the central clamping leg K1 and connecting the two clamping legs K2, K3, so that the flat clip element attached by said ramp structure rests with an increased holding effect on the paper stack to be clipped.

The structures shown here, ramp device 520, 521, center leg guide device (linear guide 522) and ram element 505 may be combined in a self-adjusted OEM-substructure, which as such, as far as its other features are concerned, may be applied in various applicator constructions.

The positive separation of the block-like stored flat clip elements 1' may be effected in particular by a special shape of the face area 505*a* of the ram element 505. According to the detailed sketch included herein, an undercreep ramp 540 is designed at the face area, which may run underneath the flat clip element block 543, deflecting the same to such a degree, or bending off itself until merely an upper engaging strip 541 catches the front most flat clip element 1' in its rear edge. Thereby it becomes possible to align the clip block and the ram element 505 to each other and make sure that the ram element pushes off only one single flat clip element from the block 543. The height t of the engaging strip preferably corresponds to the thickness of the flat clip element 1'. The ram element 505 can be guided in a guide structure 542, acting directly as a block stopper, or may be inflexibly connected with the block stopper. It is possible to provide the engaging strip 541 so that it is designed concavely or slightly sloping, so that the flat clip element cannot slide off the face area 505*a* of the ram element, and the engaged flat clip element 1' is in tendency pressed more towards to the undercreep ramp 540.

The undercreep ramp 540 is preferably designed so that its width b1 is smaller than the width b2 of the flat clip element 1'. Thereby it becomes possible to laterally deflect the clip 1', when being pushed forward, in such manner onto the face area of the ram 505*a*, that the ram element 505 engages the flat clip element 1' in a particular positive manner. The respective positions of the flat clip element 1' at the face area 505*a* are illustrated in the attached sketches Y3, Y4. Sketch Y3 depicts the position of the flat clip element relative to the ram element 505 directly when the flat clip element 1' is pushed off the stack. Sketch Y4 depicts the position of the flat clip element 1' relative to the ram element 505 after the latter has already travelled a short distance of about 7 mm.

Figure 34:
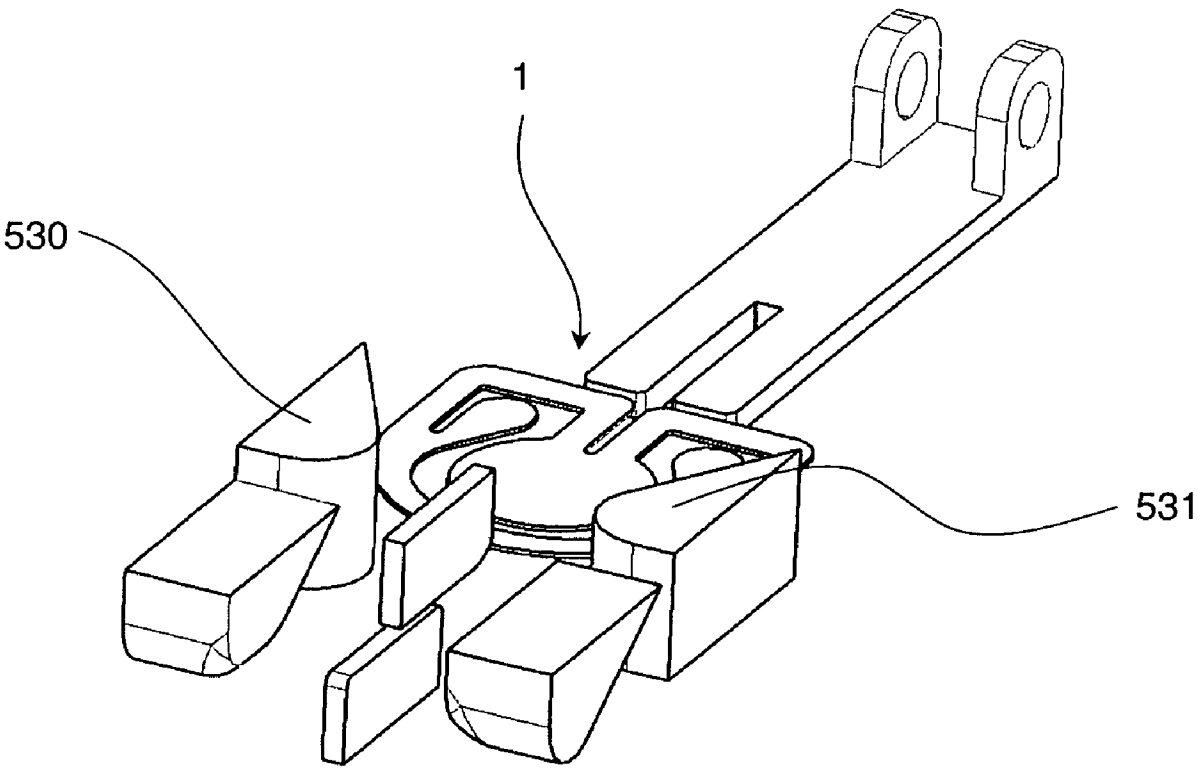
FIG. 34 is a diagrammatic view similar to FIG. 33 with additional guide structures for plastic pre-bending of a flat material clip.

FIG. 34 depicts another variation of a spreader device for expanding the flat clip 1 according to the invention, generally corresponding in its construction to the variation described above in FIG. 33, whereby here side ramps 530, 531 are additionally provided acting on the edge area of the flat clip element 1 by which a defined plastic deformation of the flat clip element can be reached during the expanding process.

The invention has been described in relation to preferred embodiments, which are intended to be illustrative, not limiting. Various changes and modifications can be made without departing from the scope of the invention, as would be readily understood by those of ordinary skill in the art.

The invention claimed is:

1. Flat clip element stack with a plurality of substantially flat clip elements whereby each flat clip element is designed to provide a clipping space for receiving an object edge by the application of clamping forces, each flat clip element including a center clamping leg to be placed on one side of an object and a pair of lateral clamping legs provided on each side of the center clamping leg such that the center clamping leg is provided in a generally common plane between the lateral clamping legs, each lateral clamping leg being spaced from the center clamping leg to define a clipping gap, the lateral clamping legs being configured to be placed on an opposite side of the object, whereby the center clamping leg and the lateral clamping legs are connected by a bridge portion and the center and lateral clamping legs as well as the bridge portion are integrally designed, whereby several of such flat clip elements are detachably combined to said flat clip element stack in such a manner that for the application of a flat clip element on an object a front most flat clip element is pushed off the flat clip element stack.

2. Flat clip element stack according to claim 1, wherein the flat clip elements are connected with each other by a varnish or film structure.

3. Flat clip element stack according to claim 2, wherein the varnish or film structure has or forms at least one of an image and a text area.

4. Flat clip element stack according to claim 1, wherein the flat clip elements are adhesively connected with each other.

5. Flat clip element stack according to claim 1, wherein the flat clip elements are connected with each other by a local welding area.

6. Flat clip stack according to claim 1, wherein the flat clip elements are connected with each other via a magazine device.

7. Flat clip element stack according to claim 1, wherein the flat clip element is manufactured out of at least one of an elastic material, a composite material and a metal material.

8. Flat clip element stack according to claim 1, wherein the flat clip elements are punched parts.

9. Flat clip element stack according to claim 1, wherein the flat clip elements are preformed under bending.

10. Flat clip element stack according to claim 1, wherein the flat clip elements are provided with an image section.

11. Flat clip element stack according to claim 1, each flat clip element is provided with an electronic memory device.

12. Flat clip element stack according to claim 1, wherein at least one of the flat clip element can be used as a data carrier for a document management system.

13. Flat clip element stack according to claim 1, wherein at least one of the flat clip elements is provided with an interface device for data transfer between the data carrier device and a data processing system.

14. The flat clip element stack of claim 1, further comprising a clipping gap provided between the center clamping leg and each of the lateral clamping legs.

15. The clip element stack of claim 14, wherein the clipping gaps converge towards one another along a direction towards the bridge portion.

16. The flat clip element stack of claim 1, wherein the center clamping leg, the base portion and/or the lateral clamping legs has a cross-sectional shape that includes a major dimension in the common plane and a minor dimension transverse to the common plane.

17. The flat clip element stack of claim 1, further comprising a torsion support flank provided to each lateral clamping leg.

18. The flat clip element stack of claim 17, wherein each said torsion support flank is provided to a root of the respective lateral clamping leg, and the lateral clamping legs are parallel to one another for a distance extending from the respective roots.

19. A substantially flat clip element for the application of clamping forces on both sides of an object edge with:

a base member manufactured out of an elastically deformable flat material, a center clamping leg configured to rest in an application position on one side of an object, the center clamping leg having a generally cylindrical head portion, a pair of lateral clamping legs provided on each side of the center clamping leg such that the center clamping leg is provided between the lateral clamping legs, the pair of lateral clamping legs being configured to rest in an application position of the flat clip element on an opposite side of the object, a bridge portion formed by the base member connecting the center and lateral clamping legs with each other and extending in the application position of the flat clip element in the vicinity of the edge of the object, wherein each said lateral clamping leg is provided with a torsion support flank for the application of torsion support force in such manner that it aligns a resting area of the respective lateral clamping leg substantially parallel to the object contact area.

20. Flat clip element according to claim 19, wherein the torsion support flanks are provided in the area of the root of the lateral clamping legs.

21. Flat clip element according to claim 19, wherein the torsion support flanks are provided in the area of the front ends of the lateral clamping legs.

22. Flat clip element according to claim 19, wherein the torsion support flanks are designed so that they apply a release torsion moment on the lateral clamping legs, opposing a bending moment becoming effective at the bridge portion because of lateral forces acting in the bridge portion.

23. Flat clip element according to claim 19, wherein the center clamping leg is partially divided in a longitudinal direction.

24. Flat clip element according to claim 19, wherein one or more of the center and/or lateral clamping legs is provided with one or more longitudinal creases.

25. Flat clip element according to claim 24, wherein the one or more longitudinal creases are designed so that the respective leg is concavely bulged towards the contact side of the paper stack.

26. Flat clip element according to claim 24, wherein the one or more longitudinal creases extend into the bridge portion.

27. Flat clip element according to claim 24, wherein the bridge portion has a pre-bent, w-form defined by the terminal areas of the one or more longitudinal creases.

28. Flat clip element according to claim 19, wherein one or more of the center and/or lateral clamping legs is reinforced by one or more longitudinal hollows.

29. Flat clip element according to claim 28, wherein the depth of the one or more hollows is smaller than three times the thickness of the clip.

30. Flat clip element according to claim 19, wherein one or more of the center or lateral clamping legs includes a crimped portion along an axis running transverse to the push-on direction.

31. Flat clip element according to claim 19, wherein the base member is comprises a metal material.

32. Flat clip element according to claim 19, wherein the base member is comprises steel material.

33. Flat clip element according to claim 19, wherein the base member comprises a plastic material.

34. Flat clip element according to claim 19, the base member is designed as a composite material body.

35. Flat clip element according to claim 19, wherein the base member is reinforced with a metal insert.

36. Flat clip element according to claim 19, wherein the base member is a punched part.

37. Flat clip element according to claim 19, wherein adjacent leg portions of the center and/or lateral clamping legs are at least section-wise separated from each other by shearing areas.

38. Flat clip element according to claim 37, wherein at least one of the leg portions or the bridge portion has local crimps.

39. Flat clip element according to claim 37, wherein at least one of the leg portions is reinforced by reshaping structures.

40. Flat clip element according to claim 19, wherein the thickness of the base member is in the area of 0.5% to 4.0%, of the width thereof.

41. Flat clip element according to claim 19, wherein the length of the base member is in the area of 50 to 140% of the width of the base member.

42. Flat clip element stack with a plurality of flat clip elements according to claim 19.

43. Clip elements for clipping objects, including paper stacks of at least 2 to 20 sheets, by the application of clamping forces on both sides of an object edge with:

a base member manufactured out of a metallic and elastically deformable material, a center clamping leg formed by the base member resting in an application position on one side of an object, a pair of lateral clamping legs formed by the base member resting in an application position of the clip element on an opposite side of the object, a bridge portion formed by the base member connecting the center and lateral clamping legs and extending in the application position of the clip element in the vicinity of the object edge, whereby the clip elements are detachably combined into a clip stack in such a manner that the clip elements can be successively pushed off the clip stack, wherein:

the center and lateral clamping legs and the bridge portion are formed in a generally common plane when not in the application position, each clip element is structured to be removed from the paper stack without damaging either the clip element or the paper stack, each clip element is structured to be used after removal from the application position, the center clamping leg is provided between the lateral clamping legs, each lateral clamping leg is spaced from the center clamping leg to form a clipping gap, and when said clip elements are detachably combined into the clip stack, the center leg, lateral clamping legs and clipping gaps from the respective clipping elements align with one another.

44. The clip elements of claim 43, further comprising a varnish or film structure to detachably combine the clip elements.

45. The clip elements of claim 43, further comprising a torsion support flank provided to each lateral clamping leg.

46. The clip elements of claim 45, wherein each said torsion support flank is provided to a root of the respective lateral clamping leg.

47. The clip elements of claim 43, wherein the clipping gaps converge towards one another along a direction towards the bridge portion.

48. The clip elements of claim 43, wherein the center clamping leg, the base portion and/or the lateral clamping legs has a cross-sectional shape that includes a major dimension in the common plane and a minor dimension transverse to the common plane.

* * * * *